US009366463B2

(12) United States Patent
Higashiyama et al.

(10) Patent No.: US 9,366,463 B2
(45) Date of Patent: Jun. 14, 2016

(54) EVAPORATOR

(75) Inventors: Naohisa Higashiyama, Oyama (JP); Osamu Kamoshida, Oyama (JP); Motoyuki Takagi, Oyama (JP); Takashi Hirayama, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 582 days.

(21) Appl. No.: 13/280,574

(22) Filed: Oct. 25, 2011

(65) Prior Publication Data

US 2012/0096894 A1 Apr. 26, 2012

(30) Foreign Application Priority Data

Oct. 25, 2010 (JP) ..... 2010-238334

(51) Int. Cl.

| | |
|---|---|
| ***F28F 9/02*** | (2006.01) |
| ***F28F 9/22*** | (2006.01) |
| ***F25B 39/02*** | (2006.01) |
| ***F28D 1/053*** | (2006.01) |

(52) U.S. Cl.

CPC ..... *F25B 39/02* (2013.01); *F28D 1/05391* (2013.01); *F28F 9/0204* (2013.01)

(58) Field of Classification Search

CPC ..... F28F 19/004; F28F 2210/02; F28F 9/22; F28F 9/0212; F28F 9/0202; F28F 2009/222; F28F 9/0204; F25B 39/02

USPC ..... 62/524–526, 519; 165/176

See application file for complete search history.

(56) References Cited

U.S. PATENT DOCUMENTS

| | | | | |
|---|---|---|---|---|
| 5,203,407 | A * | 4/1993 | Nagasaka | 165/174 |
| 7,219,511 | B2 * | 5/2007 | Inaba | F28D 1/0333 165/153 |
| 7,726,387 | B2 * | 6/2010 | Higashiyama | F25B 39/022 165/144 |
| 2004/0206490 | A1 * | 10/2004 | Katoh | F25B 39/02 165/174 |
| 2005/0172664 | A1 * | 8/2005 | Cho | F28D 1/05391 62/515 |
| 2009/0166017 | A1 * | 7/2009 | Katoh | 165/153 |
| 2010/0206535 | A1 * | 8/2010 | Munoz | F25B 39/028 165/173 |
| 2013/0087315 | A1 * | 4/2013 | Hamaguchi | F28F 1/126 165/151 |

FOREIGN PATENT DOCUMENTS

| | | | |
|---|---|---|---|
| JP | 5-96784 | U | 12/1993 |
| JP | 10-281684 | * | 3/1998 |

(Continued)

OTHER PUBLICATIONS

Japanese Office Action in corresponding JP Patent Application No. 2010-238334.

*Primary Examiner* — Frantz Jules
*Assistant Examiner* — Martha Tadesse
(74) *Attorney, Agent, or Firm* — Mori & Ward, LLP

(57) ABSTRACT

A leeward upper header portion of an evaporator includes first through third sections which communicate with upper ends of heat exchange tubes of first through third tube groups of a leeward tube row. The second tube group, which is an upward flow tube group, and the third tube group, which is a downward flow tube group, form a tube group set. A baffle plate is provided in the second section to be located on the side toward the third section. The baffle plate divides a portion of the interior of the second section into upper and lower spaces and prevents flow of refrigerant toward the upper space. A flow prevention member is provided below the baffle plate so as to prevent flow of refrigerant from the second section into the third section. These two sections communicate with each other in a region above the baffle plate.

3 Claims, 10 Drawing Sheets

(56) References Cited

FOREIGN PATENT DOCUMENTS

| | | | | |
|---|---|---|---|---|
| JP | 10-281684 | A | | 10/1998 |
| JP | 10281684 | A | * | 10/1998 |
| JP | 2008-26776 | A | | 11/2008 |
| JP | 2008-267764 | A | | 11/2008 |
| JP | 2009-156532 | A | | 7/2009 |
| JP | 2009-166368 | A | | 7/2009 |
| JP | 2010-223464 | A | | 10/2010 |
| KR | 10-2005-0136225 | | * | 12/2005 ..... F25B 39/00 |

* cited by examiner

EVAPORATOR

BACKGROUND OF THE INVENTION

The present invention relates to an evaporator suitable for use in a car air conditioner, which is a refrigeration cycle to be mounted on an automobile, for example.

In this specification and appended claims, the upper and lower sides of each drawing will be referred to as "upper" and "lower," respectively.

An evaporator of such a type has been proposed (see Japanese Patent Application Laid-Open (kokai) No. 2009-156532). The proposed evaporator comprises a plurality of heat exchange tubes extending in the vertical direction, and upper and lower header portions to which upper and lower end portions of the heat exchange tubes are connected, respectively. There are provided upward flow tube groups each of which is formed by a plurality of heat exchange tubes spaced from one another in the longitudinal direction of the header portions and in which refrigerant flows through the heat exchange tubes from the lower side toward the upper side, and downward flow tube groups each of which is formed by a plurality of heat exchange tubes disposed at predetermined intervals in the longitudinal direction of the header portions and in which refrigerant flows through the heat exchange tubes from the upper side toward the lower side. The evaporator includes two tube rows juxtaposed in the air-passage direction, each tube row is formed by a plurality of tube groups spaced from one another in the longitudinal direction of the header portions. The leeward tube row includes three or more tube groups, and the windward tube row includes a plurality of tube groups the number of which is one less than the number of the tube groups of the leeward tube row. The flow direction of refrigerant in one of adjacent tube groups is opposite the flow direction of refrigerant in the other tube group. Upper and lower end portions of the heat exchange tubes of the leeward tube row and upper and lower end portions of the heat exchange tubes of the windward tube row are connected to the leeward upper and lower header portions and the windward upper and lower header portions, respectively. Each of the leeward upper and lower header portions has sections which are equal in number to the tube groups of the leeward tube row, and the heat exchange tubes of each tube group of the leeward tube row communicate with the corresponding section. Each of the windward upper and lower header portions has sections which are equal in number to the tube groups of the windward tube row, and the heat exchange tubes of each tube group of the windward tube row communicate with the corresponding section. A refrigerant inlet is provided at a section at one end of the leeward upper or lower header portion. A refrigerant outlet is provided on a windward upper or lower header portion corresponding to the leeward upper or lower header portion on which the refrigerant inlet is provided, such that the refrigerant outlet is provided at a section at one end of the windward upper or lower header portion located on the same side as the one end at which the refrigerant inlet is provided. The evaporator has upflow paths each formed by one upward flow tube group, and downflow paths each formed by at least one downward flow tube group. The upflow paths and the downflow paths are alternately disposed such that the final path becomes an upflow path or a downflow path. Refrigerant having flowed from the refrigerant inlet is caused to pass through all the paths and flow out from the refrigerant outlet. Refrigerant flows from the upper side toward the lower side through the heat exchange tubes of a farthest tube group of the leeward tube row which is farthest from the refrigerant inlet and through the heat exchange tubes of a farthest tube group of the windward tube row which is farthest from the refrigerant outlet. These two farthest tube groups form a single downflow path. A tube group located on the upstream side, with respect to the refrigerant flow direction, of the farthest tube group of the leeward tube row is an upward flow tube group. The upper header portion has a refrigerant inflow section which communicates with upper end portions of the heat exchange tubes of the upward flow tube group, and a refrigerant outflow section which communicates with upper end portions of the heat exchange tubes of the downward flow tube group located adjacent to and downstream of the upward flow tube group with respect to the refrigerant flow direction. The refrigerant inflow section and the refrigerant outflow section communicate with each other via an opening provided between the two sections such that the opening extends over the entire boundary between the two sections.

In general, an evaporator used in a car air conditioner is desired to be designed such that a discharged air temperature, which is the temperature of air jetted from air-passing clearances each formed between adjacent heat exchange tubes, is made uniform among various parts of the evaporator in order to improve the comfort within a compartment of a vehicle on which the car air conditioner is mounted. For making the discharged air temperature uniform, the diverging flows of refrigerant within the evaporator must be adjusted.

Incidentally, in the evaporator described in the publication, refrigerant having entered the evaporator via the refrigerant inlet partially evaporates in the above-described upward flow tube group and a tube group located upstream of the upward flow tube group with respect to the refrigerant flow direction. Therefore, two-phase refrigerant (having a gas phase component and a liquid phase component) flows into the refrigerant inflow section of the upper header portion which communicates with the upper end portions of the heat exchange tubes of the upward flow tube group.

However, the opening formed between the two sections such that the opening extends over the entire interface between the two sections establishes communication between the interior of the refrigerant inflow section of the upper header portion which communicates with upper end portions of the heat exchange tubes of the upward flow tube group, and the interior of the refrigerant outflow section of the upper header portion which communicates with upper end portions of the heat exchange tubes of the downward flow tube group located adjacent to and downstream of the upward flow tube group with respect to the refrigerant flow direction. Therefore, refrigerant having flowed into the refrigerant inflow section flows straight into the refrigerant outflow section. Thus, the refrigerant flows into the refrigerant outflow section without the gas phase component and the liquid phase component being mixed together. Accordingly, the liquid phase component flows, in a large amount, into the upstream-side heat exchange tubes of the downward flow tube group due to the influence of gravity, and the gas phase component becomes more likely to flow within the refrigerant outflow section toward the downstream side, whereby the gas phase component flows, in a large amount, into downstream-side heat exchange tubes of the downward flow tube group. As a result, the amount of refrigerant flowing through the heat exchange tubes of the downward flow tube group (serving as a downflow path) located downstream of the upward flow tube group (serving as an upflow path) with respect to the refrigerant flow direction becomes ununiform, whereby the discharged air temperature becomes ununiform among various portions of the evaporator.

SUMMARY OF THE INVENTION

An object of the present invention is to solve the above problem and to provide an evaporator which can make uniform diverging flows of refrigerant into heat exchange tubes which constitute a downward flow tube group located adjacent to and downstream of an upward flow tube group with respect to a refrigerant flow direction.

To fulfill the above object, the present invention comprises the following modes.

1) An evaporator comprising a plurality of heat exchange tubes extending in a vertical direction, and upper and lower header portions to which upper and lower end portions of the heat exchange tubes are connected, the evaporator including at least one tube group set composed of an upward flow tube group which is formed by arranging a plurality of heat exchange tubes at predetermined intervals in a longitudinal direction of the header portions and in which refrigerant flows through the heat exchange tubes from the lower side toward the upper side, and a downward flow tube group which is formed by arranging a plurality of heat exchange tubes at predetermined intervals in the longitudinal direction of the header portions, which is located adjacent to and downstream of the upward flow tube group with respect to a refrigerant flow direction, and in which refrigerant flows through the heat exchange tubes from the upper side toward the lower side, the upper header portion including a refrigerant inflow section which communicates with upper end portions of the heat exchange tubes of the upward flow tube group and into which refrigerant flows from the heat exchange tubes, and a refrigerant outflow section which communicates with upper end portions of the heat exchange tubes of the downward flow tube group and from which refrigerant flows into the heat exchange tubes, wherein a horizontal baffle is provided in the refrigerant inflow section which communicates with the upper end portions of the heat exchange tubes of the upward flow tube group of the at least one tube group set such that the baffle is located at a central position in the vertical direction and is located on the side toward the refrigerant outflow section which communicates with the upper end portions of the heat exchange tubes of the downward flow tube group, which constitutes the tube group set together with the upward flow tube group, the baffle dividing a portion of the interior of the refrigerant inflow section into upper and lower spaces and preventing flow of refrigerant toward the upper space; a flow prevention member is provided below the horizontal baffle so as to prevent flow of refrigerant from the refrigerant inflow section into the refrigerant outflow; and the refrigerant inflow section and the refrigerant outflow section communicate with each other in a region above the horizontal baffle.

2) An evaporator according to par. 1), comprising two tube rows which are juxtaposed in an air-passage direction and each of which includes a plurality of tube groups arranged in the longitudinal direction of the header portions, wherein at least one of the tube rows includes the at least one tube group set composed of the upward flow tube group and the downward flow tube group; and the horizontal baffle is provided in the refrigerant inflow section of the upper header section which communicates with the upper end portions of the heat exchange tubes of the upward flow tube group of the at least one tube group set, the baffle dividing a portion of the interior of the refrigerant inflow section into upper and lower spaces and preventing flow of refrigerant toward the upper space.

3) An evaporator according to par. 2), wherein a tube row on the leeward side includes three or more tube groups, and a tube row on the windward side includes tube groups, the number of which is one less than the number of the tube groups of the leeward tube row; upper and lower end portions of heat exchange tubes of the leeward tube row are connected to leeward upper and lower header portions, and upper and lower end portions of heat exchange tubes of the windward tube row are connected to windward upper and lower header portions; each of the leeward upper and lower header portions includes sections which are equal in number to the tube groups of the leeward tube row and which communicate with the heat exchange tubes of the corresponding tube groups of the leeward tube row; each of the windward upper and lower header portions includes sections which are equal in number to the tube groups of the windward tube row and which communicate with the heat exchange tubes of the corresponding tube groups of the windward tube row; a refrigerant inlet is provided at a section at one end of the leeward upper or lower header portion, and an refrigerant outlet is provided on a windward upper or lower header portion corresponding to the leeward upper or lower header portion on which the refrigerant inlet is provided, such that the refrigerant outlet is provided at a section at one end of the windward upper or lower header portion located on the same side as the one end at which the refrigerant inlet is provided; upflow paths each composed of one upward flow tube group and downflow paths each composed of at least one downward flow tube group are alternately arranged such that a final path becomes an upflow path or a downflow path, refrigerant from the refrigerant inlet passing through all the paths, and flowing out from the refrigerant outlet; refrigerant flows in the same direction through the heat exchange tubes of a farthest tube group of the leeward tube row which is farthest from the refrigerant inlet and through the heat exchange tubes of a farthest tube group of the windward tube row which is farthest from the refrigerant outlet; and these two farthest tube groups form one upflow path or downflow path.

4) An evaporator according to par. 3), wherein each of the farthest tube group of the leeward tube row and the farthest tube group of the windward tube row is a downward flow tube group; the two farthest tube groups form a downflow path; a tube group located upstream of the farthest tube group of the leeward tube row with respect to the refrigerant flow direction is an upward flow tube group; and a horizontal baffle is provided in the refrigerant inflow section of the leeward upper header portion which communicates with upper end portions of the heat exchange tubes of the upward flow tube group of the tube group set composed of the farthest tube group of the leeward tube row and the upward flow tube group located upstream of the farthest tube group with respect to the refrigerant flow direction, the baffle dividing a portion of the interior of the refrigerant inflow section into upper and lower spaces and preventing flow of refrigerant toward the upper space.

5) An evaporator according to par. 4), wherein the leeward tube row includes three tube groups, the windward tube row includes two tube groups, and the final path is an upflow path.

6) An evaporator according to par. 1), wherein, of all the heat exchange tubes of the upward flow tube group communicating with the refrigerant inflow section in which the horizontal baffle is provided, heat exchange tubes, the number of which is 3/16 to 1/2 the number of all the heat exchange tubes, are present in a region in which the horizontal baffle is provided.

7) An evaporator according to par. 2), wherein the number of tube groups of the tube row on the leeward side is two or more and equal to the number of tube groups of the tube row on the windward side; upper and lower end portions of heat exchange tubes of the leeward tube row are connected to leeward upper and lower header portions, and upper and lower end portions of heat exchange tubes of the windward tube row are connected to windward upper and lower header portions; each of the leeward upper and lower header portions includes sections which are equal in number to the tube groups of the leeward tube row and which communicate with the heat exchange tubes of the corresponding tube groups of the leeward tube row; each of the windward upper and lower header portions includes sections which are equal in number to the tube groups of the windward tube row and which communicate with the heat exchange tubes of the corresponding tube groups of the windward tube row; a refrigerant inlet is provided at a section at one end of the leeward upper or lower header portion, and an refrigerant outlet is provided on a windward upper or lower header portion corresponding to the leeward upper or lower header portion on which the refrigerant inlet is provided, such that the refrigerant outlet is provided at a section at one end of the windward upper or lower header portion located on the same side as the one end at which the refrigerant inlet is provided; of all tube groups, each upward flow tube group forms an upflow path, and each downward flow tube group forms a downflow path; the upflow paths and the downflow paths are alternately arranged such that a final path becomes an upflow path or a downflow path; and refrigerant from the refrigerant inlet passes through all the paths, and flows out from the refrigerant outlet.

8) An evaporator according to par. 7), wherein a farthest tube group of the leeward tube row which is farthest from the refrigerant inlet is a downward flow tube group, and a tube group located upstream of the farthest tube group of the leeward tube row with respect to the refrigerant flow direction is an upward flow tube group; and a horizontal baffle is provided in the refrigerant inflow section of the leeward upper header portion which communicates with upper end portions of the heat exchange tubes of the upward flow tube group of the tube group set composed of the farthest tube group of the leeward tube row and the upward flow tube group located upstream of the farthest tube group with respect to the refrigerant flow direction, the baffle dividing a portion of the interior of the refrigerant inflow section into upper and lower spaces and preventing flow of refrigerant toward the upper space.

9) An evaporator according to par. 8), wherein each of the leeward tube row and the windward tube row includes three tube groups, a tube group of the windward tube row located at the end where the refrigerant outlet is provided is an upward flow tube group, and the final path is an upflow path.

In an evaporator according to any one of pars. 1) to 9), a horizontal baffle is provided in the refrigerant inflow section of the upper header portion such that the baffle is located at a central position in the vertical direction and is located on the side toward the refrigerant outflow section, the baffle dividing a portion of the interior of the refrigerant inflow section into upper and lower spaces and preventing flow of refrigerant toward the upper space; a flow prevention member is provided below the horizontal baffle so as to prevent flow of refrigerant from the refrigerant inflow section into the refrigerant outflow section; and the refrigerant inflow section and the refrigerant outflow section communicate with each other in a region above the horizontal baffle. Therefore, refrigerant having flowed from the upward flow tube group into a region of the refrigerant inflow section in which the horizontal baffle is provided first flows along the horizontal baffle toward the side opposite the refrigerant outflow section, flows upward beyond the horizontal baffle, flows through a region of the refrigerant inflow section above the horizontal baffle, and then flows into the refrigerant outflow section. Meanwhile, refrigerant having flowed into a region of the refrigerant inflow section in which the horizontal baffle is not provided flows upward beyond the horizontal baffle, flows through the region of the refrigerant inflow section above the horizontal baffle, and then flows into the refrigerant outflow section. Therefore, even in the case where refrigerant flowing from the refrigerant inlet partially evaporates in the upward flow tube group and the tube group located upstream of the upward flow tube group and is separated into gas and liquid, whereby gas/liquid two-phase refrigerant flows into the refrigerant inflow section, a portion of the gas/liquid two-phase refrigerant flows over a long distance along the horizontal baffle within the refrigerant inflow section, whereby the gas phase component and the liquid phase component are mixed sufficiently. Therefore, it is possible to prevent the liquid phase component from concentratedly flowing, in a large amount, into upstream-side heat exchange tubes of the downward flow tube group, which constitutes the tube group set together with the upward flow tube group, which flows would otherwise occur due to the influence of gravity. Thus, refrigerant having gas and liquid phase components and having a constant dryness uniformly enters all the heat exchange tubes of the downward flow tube group, whereby diverging flows of refrigerant into all the heat exchange tubes of the downward flow tube group can be made uniform.

According to the evaporator of par. 9), the diverging flows of refrigerant into all the heat exchange tubes of the downward flow tube group can be made uniform effectively.

DESCRIPTION OF THE PREFERRED EMBODIMENTS

Figure 1:
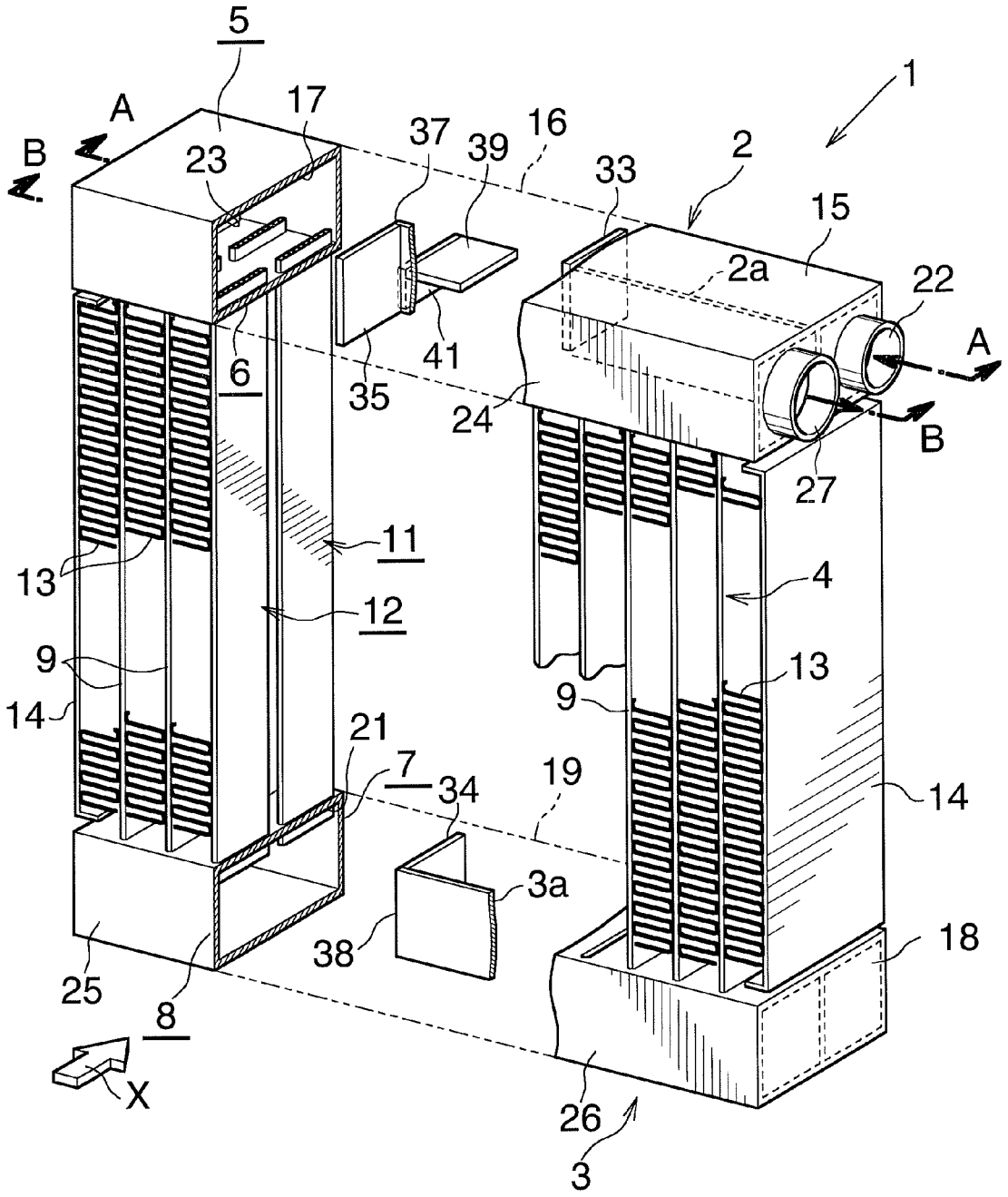
FIG. 1 is a partially cut-away perspective view showing the overall structure of an evaporator according to a first embodiment of the present invention.

Embodiments of the present invention will next be described with reference to the drawings. In the embodiments which will be described below, the evaporator of the present invention is applied to a refrigeration cycle which constitutes a car air conditioner.

Like portions and members are denoted by like reference numerals throughout the drawings, and repeated description is not provided.

In the following description, the term "aluminum" encompasses aluminum alloys in addition to pure aluminum.

In the following description, the downstream side (a direction represented by arrow X in FIGS. 1, 2, 5, and 10) of an air flow through air-passing clearances between adjacent heat exchange tubes will be referred to as the "front," and the opposite side as the "rear." Furthermore, the left-hand and right-hand sides of each drawing will be referred to as "left" and "right," respectively.

First Embodiment

Figure 2:
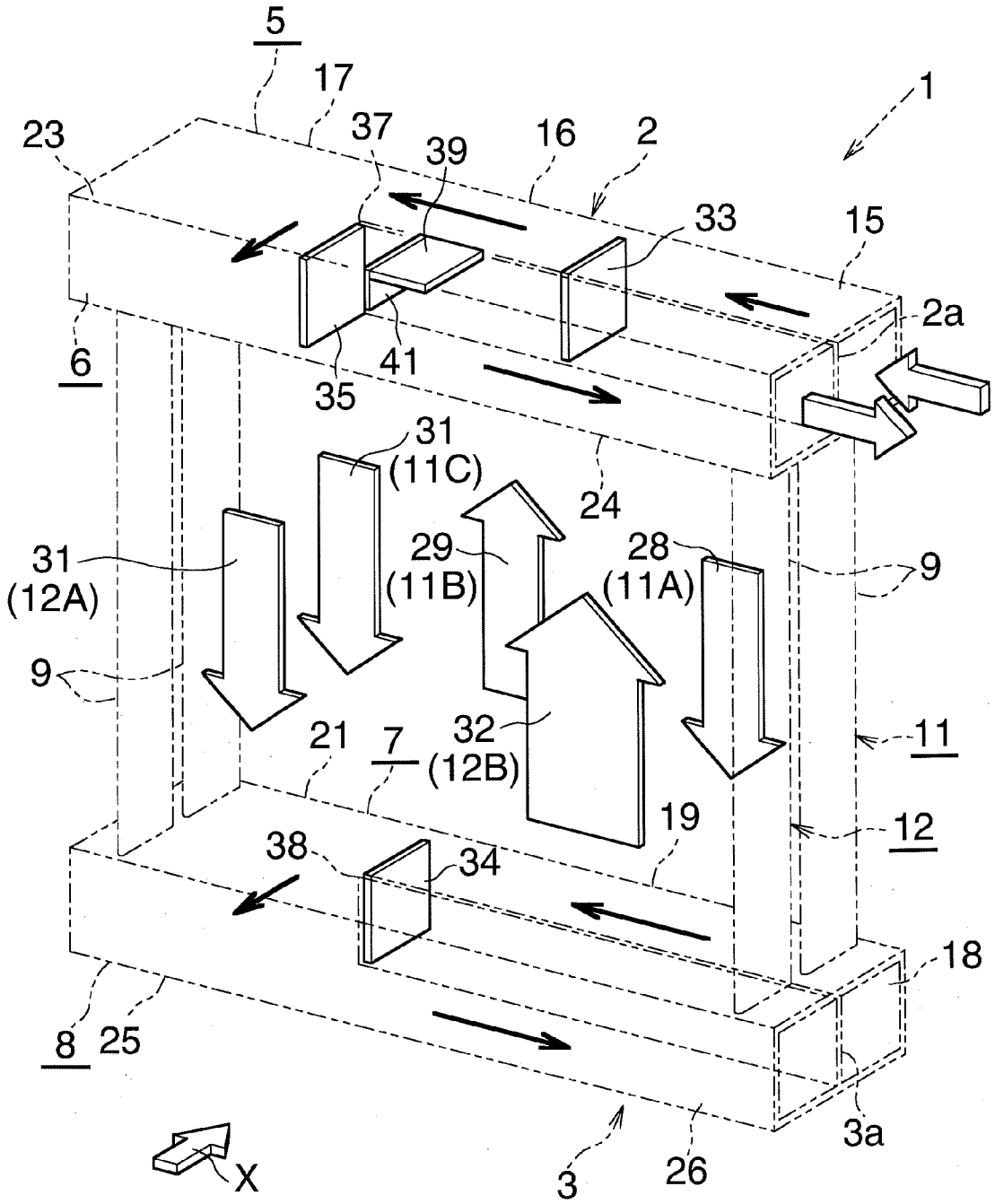
FIG. 2 is a perspective view schematically showing the structure of the evaporator of FIG. 1 and the flow of refrigerant within the evaporator.
Figure 4:
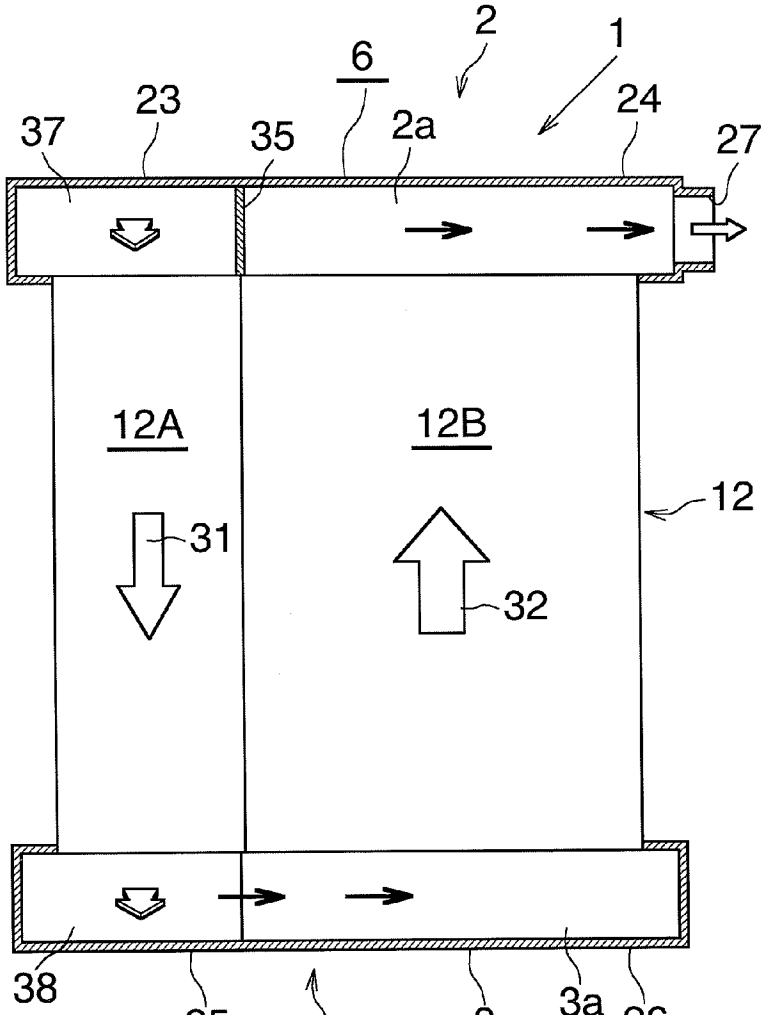
FIG. 4 is a sectional view taken along line B-B of FIG. 1 and schematically showing the structure of the evaporator of FIG. 1.
Figure 3:
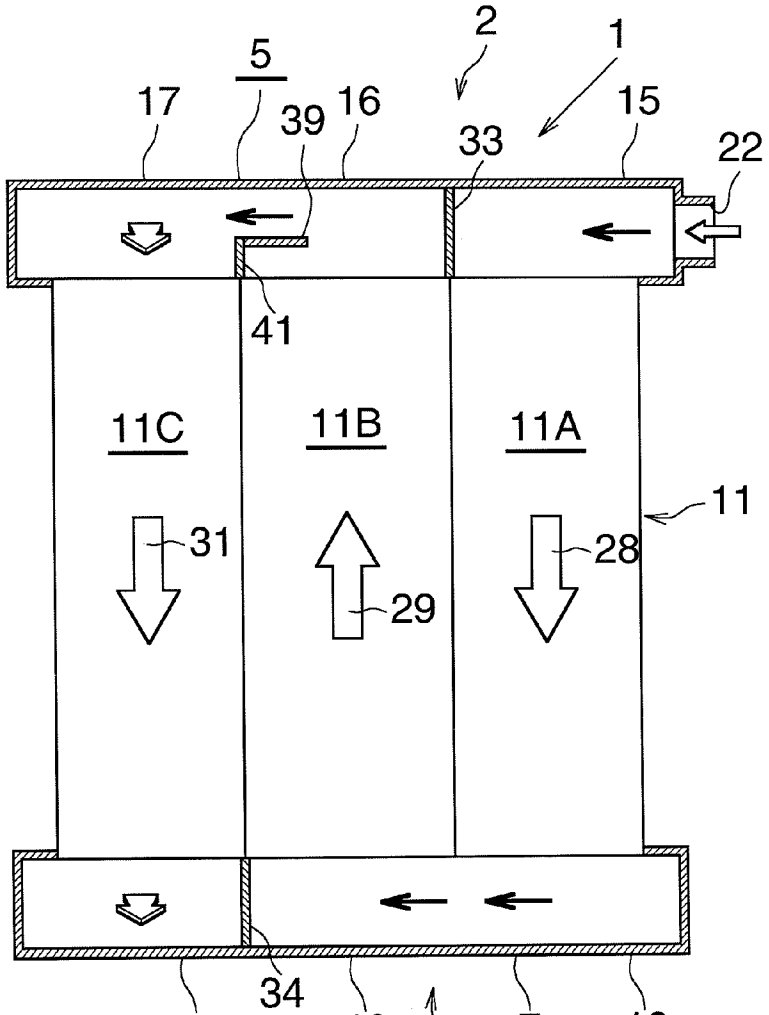
FIG. 3 is a sectional view taken along line A-A of FIG. 1 and schematically showing the structure of the evaporator of FIG. 1.

FIGS. 1 to 4 show a first embodiment of the present invention. FIG. 1 shows the overall structure of an evaporator, and FIGS. 2 to 4 schematically show the structure of the evaporator. Notably, in FIGS. 2 to 4, heat exchange tubes and fins are not illustrated.

As shown in FIG. 1, an evaporator 1 includes a first header tank 2 and a second header tank 3 formed of aluminum and disposed apart from each other in the vertical direction; and a heat exchange core portion 4 provided between the two header tanks 2, 3.

The first header tank 2 includes a leeward header portion 5 located on the leeward side (front side), and a windward header portion 6 located on the windward side (rear side) and united with the leeward header portion 5. In the present embodiment, the leeward header portion 5 and the windward header portion 6 are provided by means of partitioning the first header tank 2 into front and rear portions by a partition portion 2*a*. The second header tank 3 includes a leeward header portion 7 located on the leeward side (front side), and a windward header portion 8 located on the windward side (rear side) and united with the leeward header portion 7. In the present embodiment, the leeward header portion 7 and the windward header portion 8 are provided by means of partitioning the second header tank 3 into front and rear portions by a partition portion 3*a*.

In the following description, the leeward header portion 5 of the first header tank 2 will be referred to as the leeward upper header portion; the leeward header portion 7 of the second header tank 3 will be referred to as the leeward lower header portion; the windward header portion 6 of the first header tank 2 will be referred to as the windward upper header portion; and the windward header portion 8 of the second header tank 3 will be referred to as the windward lower header portion.

The heat exchange core portion 4 is configured as follows. Two tube rows 11, 12 are juxtaposed in the front-rear direction. Each of the tube rows 11, 12 is composed of a plurality of flat heat exchange tubes 9 made of aluminum. The heat exchange tubes 9 are disposed such that their width direction coincides with the air-passage direction, their longitudinal direction coincides with the vertical direction, and they are spaced from one another in the left-right direction (the longitudinal direction of the header portions). Corrugated fins 13 made of aluminum are disposed in air-passing clearances between the adjacent heat exchange tubes 9 of each tube row 11, 12 and externally of the left- and right-end heat exchange tubes 9 such that the corrugated fins 13 extend over the heat exchange tubes 9 of the front and rear tube rows 11, 12, and are brazed to the corresponding heat exchange tubes 9. Side plates 14 made of aluminum are disposed externally of the left- and right-end corrugated fins 13, and are brazed to the corresponding corrugated fins 13. Upper and lower end portions of the heat exchange tubes 9 of the leeward tube row 11 are communicatably connected to the leeward upper and lower header portions 5, 7; and upper and lower end portions of the heat exchange tubes 9 of the windward tube row 12 are communicatably connected to the windward upper and lower header portions 6, 8. Notably, the number of the heat exchange tubes 9 of the leeward tube row 11 is equal to the number of the heat exchange tubes 9 of the windward tube row 12. All the heat exchange tubes 9 have the same structure, and are identical with one another in terms of the number of the refrigerant channels and the total channel cross sectional area of the plurality of refrigerant channels.

As shown in FIGS. 2 to 4, the leeward tube row 11 includes three tube groups 11A, 11B, 11C, each of which is composed of a plurality of heat exchange tubes 9 disposed at predetermined intervals in the left-right direction and which are arranged from the right end toward the left end; and the windward tube row 12 includes two tube groups 12A, 12B (the number of which is one less than the number of the tube groups of the leeward tube row 11) each of which is composed of a plurality of heat exchange tubes 9 disposed at predetermined intervals in the left-right direction and which are arranged from the left end toward the right end.

The leeward upper and lower header portions 5, 7 have sections 15, 16, 17 and sections 18, 19, 21, respectively, the number of which is equal to the number of the tube groups 11A, 11B, 11C of the leeward tube row 11 and which communicate with the heat exchange tubes 9 of the tube groups 11A, 11B, 11C, respectively. A refrigerant inlet 22 is provided at the right end of the right end section 15 of the leeward upper header portion 5. The three tube groups 11A, 11B, 11C of the leeward tube row 11 will be referred to as the first to third tube groups, from the end where the refrigerant inlet 22 is provided (the right end) toward the opposite end (the left end). The sections 15, 16, 17 and the sections 18, 19, 21, with which the heat exchange tubes 9 of the first to third tube groups 11A, 11B, 11C communicate, will be referred to as the first to third sections, from the end where the refrigerant inlet 22 is provided (the right end) toward the opposite end (the left end).

The windward upper and lower header portions 6, 8 have sections 23, 24 and sections 25, 26, respectively, the number of which is equal to the number of the tube groups 12A, 12B of the windward tube row 12 and which communicate with the heat exchange tubes 9 of the tube groups 12A, 12B, respectively. A refrigerant outlet 27 is provided at the right end of the right end section 24 of the windward upper header portion 6 (at the end where the refrigerant inlet 22 is provided). The two tube groups 12A, 12B of the windward tube row 12 will be referred to as the fourth and fifth tube groups, from the end (the left end) opposite the refrigerant outlet 27 toward the end where the refrigerant outlet 27 is provided (the right end); and the sections 23, 24 and the sections 25, 26, with which the heat exchange tubes 9 of the fourth and fifth tube groups 12A, 12B communicate, will be referred to as the fourth and fifth sections, from the end (the left end) opposite the refrigerant outlet 27 toward the end where the refrigerant outlet 27 is provided (the right end).

Notably, the total number of the heat exchange tubes 9 which constitute the first and second tube groups 11A, 11B of the leeward tube row 11 is equal to the number of the heat exchange tubes 9 which constitute the fifth tube group 12B of the windward tube row 12; and the number of the heat exchange tubes 9 which constitute the third tube group 11C of the leeward tube row 11 is equal to the number of the heat exchange tubes 9 which constitute the fourth tube group 12A of the windward tube row 12. Furthermore, the respective total lengths (as measured in the left-right direction) of the first sections 15, 18 and the second sections 16, 19 of the leeward upper and lower header portions 5, 7 are equal to the respective lengths (as measured in the left-right direction) of the fifth sections 24, 26 of the windward upper and lower header portions 6, 8; and the respective lengths (as measured in the left-right direction) of the third sections 17, 21 of the leeward upper and lower header portions 5, 7 are equal to those of the fourth sections 23, of the windward upper and lower header portions 6, 8.

A partition wall 33 is provided between the first section 15 and the second section 16 of the leeward upper header portion 5, whereby communication between the two sections 15, 16 is prohibited. Meanwhile, communication is established between the second section 16 and the third section 17 of the leeward upper header portion 5.

The first section 18 of the leeward lower header portion 7 is fully opened at its left end, and the second section 19 thereof is fully opened at its right end, whereby communication is established between the two sections 18, 19. Thus, refrigerant flows straight and leftward from the first section 18 into the second section 19. A partition wall 34 is provided between the second section 19 and the third section 21 of the leeward lower header portion 7, whereby communication between the two sections 19, 21 is prohibited.

A partition wall 35 is provided between the fourth section 23 and the fifth section 24 of the windward upper header portion 6, whereby communication between the two sections 23, 24 is prohibited. Meanwhile, the fourth section 25 of the windward lower header portion 8 is fully opened at its right end, and the fifth section 26 thereof is fully opened at its left end, whereby communication is established between the two sections 25, 26. Thus, refrigerant flows straight and rightward from the fourth section 25 into the fifth section 26.

A communication opening 37 provided in the partition portion 2*a* of the first header tank 2 establishes commutation between the third section 17 of the leeward upper header portion 5 and the fourth section 23 of the windward upper header portion 6. Also, a communication opening 38 provided in the partition portion 3*a* of the second header tank 3 establishes commutation between the third section 21 of the leeward lower header portion 7 and the fourth section 25 of the windward lower header portion 8.

As a result of provision of the sections 15 to 19 and 21 to 26, the refrigerant inlet 22, the refrigerant outlet 27, and the communication openings 37, 38 as described above, refrigerant flows, from the upper side toward the lower side, through the heat exchange tubes 9 of the first tube group 11A, the heat exchange tubes 9 of the third tube group 11C which is farthest from the refrigerant inlet 22 (the farthest tube group of the leeward tube row 11), and the heat exchange tubes 9 of the fourth tube group 12A which is farthest from the refrigerant outlet 27 (the farthest tube group of the windward tube row 12); and refrigerant flows, from the lower side toward the lower side, through the heat exchange tubes 9 of the second tube group 11B (a tube group located upstream of the farthest tube group of the leeward tube row 11 with respect to the refrigerant flow direction), and the heat exchange tubes 9 of the fifth tube group 12B. That is, the second tube group 11B and the fifth tube group 12B are upward flow tube groups each of which is formed by arranging a plurality of heat exchange tubes 9 at predetermined intervals in the left-right direction and in which refrigerant flows through the heat exchange tubes 9 from the lower side toward the upper side; and the first tube group 11A, the third tube group 11C, and the fourth tube group 12A are downward flow tube groups each of which is formed by arranging a plurality of heat exchange tubes 9 at predetermined intervals in the left-right direction and in which refrigerant flows through the heat exchange tubes 9 from the upper side toward the lower side. Thus, the first tube group 11A forms a first path 28 which is a downflow path in which refrigerant flows from the upper side toward the lower side; the second tube group 11B forms a second path 29 which is an upflow path in which refrigerant flows from the lower side toward the upper side; the third and fourth tube groups 11C, 12A form a third path 31 which is a downflow path in which refrigerant flows from the upper side toward the lower side; and the fifth tube group 12B forms a fourth path 32 (final path) which is an upflow path in which refrigerant flows from the lower side toward the upper side. The third path 31, which is a downflow path, is formed by means of juxtaposing, in the air-passage direction, the third tube group 11C (the farthest tube group) of the leeward tube row 11, which is farthest from the refrigerant inlet 22, and the fourth tube group 12A (the farthest tube group) of the windward tube row 12, which is farthest from the refrigerant outlet 27. That is, in the evaporator 1, upflow paths each of which is formed by a plurality of heat exchange tubes 9 and in which refrigerant flows through the heat exchange tubes 9 from the lower side toward the upper side and downflow paths each of which is formed by a plurality of heat exchange tubes 9 and in which refrigerant flows through the heat exchange tubes 9 from the upper side toward the lower side are alternately arranged such that the fourth path (the final path) 32 serves as an upflow path.

The leeward tube row 11 of the evaporator 1 includes one tube group set composed of the second tube group 11B, which is an upward flow tube group, and the third tube group 11C, which is a downward flow tube group located adjacent to and leftward of the second tube group 11B (on the downstream side of the second tube group 11B with respect to the refrigerant flow direction). The second section 16 of the leeward upper header portion 5 serves as a refrigerant inflow section which communicates with upper end portions of the heat exchange tubes 9 of the second tube group 11B (the upward flow tube group of the one tube group set) and into which refrigerant flows from the heat exchange tubes 9. The third section 17 serves as a refrigerant outflow section which communicates with upper end portions of the heat exchange tubes 9 of the third tube group 11C (the downward flow tube group which constitutes the one tube group set together with the second tube group 11B) and from which refrigerant flows into the heat exchange tubes 9.

A horizontal, platelike baffle 39 is provided in the second section (the above-described refrigerant inflow section) 16 of the leeward upper header portion 5 to be located at the center in the vertical direction and is located on the left side; i.e., on the side toward the third section (refrigerant outflow section) 17. The baffle 39 divides a portion of the interior of the second section 16 into upper and lower spaces, and prevents flow of refrigerant toward the upper space. Under the baffle 39, a flow prevention portion 41 is provided between the second section 16 and the third section 17 in order to prevent flow of refrigerant from the second section 16 to the third section 17. Also, the second section 16 is opened at its left end in a region above the baffle 39, and the third section 17 is opened at its right end in the region above the baffle 39, whereby the two sections 16, 17 communicate with each other in the region above the baffle 39.

Preferably, of all the heat exchange tubes 9 of the second tube group 11B communicating with the second section 16 in which the baffle 39 is provided, heat exchange tubes 9, the number of which is 3/16 to ½ the number of all the heat exchange tubes 9, are present in a range (with respect to the left-right direction) over which the baffle 39 extends.

The above-described evaporator 1, together with a compressor, a condenser serving as a refrigerant cooler, and an expansion valve serving as a pressure reducer, constitutes a refrigeration cycle which is installed in a vehicle, such as an automobile, as a car air conditioner. When the car air conditioner is operated, refrigerant having passed through the compressor, the condenser, and the expansion valve enters the first section 15 of the leeward upper header portion 5 through the refrigerant inlet 22. The refrigerant having entered the first section 15 flows into the heat exchange tubes 9 of the second tube group 11B, which constitutes the second path 29, via the first tube group 11A, which constitutes the first path 28, and the first and second sections 18, 19 of the leeward lower header portion 7.

The refrigerant having flowed into the heat exchange tubes 9 of the second tube group 11B flows upward through the heat exchange tubes 9, and enters the second section 16 of the leeward upper header portion 5. The refrigerant having flowed into a region within the second section 16 where the baffle 39 is provided (having flowed into a region located leftward of the right end of the baffle 39) first flows rightward along the baffle 39, flows upward beyond the baffle 39, flows leftward in a region or space within the second section 16 above the baffle 39, and then flows into the third section 17. Meanwhile, refrigerant having flowed into a region within the second section 16 where the baffle 39 is not provided (having flowed into a region located rightward of the right end of the baffle 39) flows upward beyond the baffle 39, flows leftward in a region within the second section 16 above the baffle 39, and then flows into the third section 17.

A portion of the refrigerant having flowed into the third section 17 passes through the communication opening 37, enters the fourth section 23 of the windward upper header portion 6, and then flows into the heat exchange tubes 9 of the fourth tube group 12A, which constitutes the third path 31. Simultaneously, the remaining portion of the refrigerant having flowed into the third section 17 flows into the heat exchange tubes 9 of the third tube group 11C, which constitutes the third path 31. The refrigerant having flowed into the heat exchange tubes 9 of the fourth tube group 12A, which constitutes the third path 31, flows downward through the heat exchange tubes 9, enters the fourth section 25 of the windward lower header portion 8, and then enters the fifth section 26 thereof. Simultaneously, the refrigerant having flowed into the heat exchange tubes 9 of the third tube group 11C, which constitutes the third path 31, flows downward through the heat exchange tubes 9, and then enters the third section 21 of the leeward lower header portion 7. After that, the refrigerant passes through the communication opening 38, enters the fourth section 25 of the windward lower header portion 8, and then enters the fifth section 26 thereof. The refrigerant having entered the fifth section 26 flows into the heat exchange tubes 9 of the fifth tube group 12B, which constitutes the fourth path 32.

The refrigerant having flowed into the heat exchange tubes 9 of the fifth tube group 12B, which constitutes the fourth path 32, flows upward through the heat exchange tubes 9, enters the fifth section 24 of the windward upper header portion 6, and flows out through the refrigerant outlet 27.

While refrigerant flows through the heat exchange tubes 9 of the leeward tube row 11 and the heat exchange tubes 9 of the windward tube row 12, heat exchange is performed between the refrigerant and air passing through the air-passing clearances of the heat exchange core portion 4 (see the arrow X of FIGS. 1 and 2), whereby the air is cooled, and the refrigerant flows out in the gas phase.

In the above-described evaporator 1, since the baffle 39 is provided within the second section 16 of the leeward upper header portion 5, a portion of refrigerant having flowed into the second section 16 after having had separated into gas and liquid as a result of partial evaporation thereof while flowing through the first tube group 11A and the second tube group 11B flows over a long distance along the baffle 39, whereby the gas phase component and the liquid phase component are mixed sufficiently. Therefore, it is possible to prevent the liquid phase component from concentratedly flowing, in a large amount, into upstream side (right side) heat exchange tubes 9 of the third tube group 11C, which flows would otherwise occur due to the influence of gravity. Thus, refrigerant having gas and liquid phase components and having a constant dryness uniformly enters all the heat exchange tubes 9 of the third tube group 11C, whereby diverging flows of refrigerant into all the heat exchange tubes 9 of the third tube group 11C, which constitutes the third path 31, can be made uniform. In particular, in the case where, of all the heat exchange tubes 9 of the second tube group 11B communicating with the second section 16 in which the baffle 39 is provided, heat exchange tubes 9, the number of which is 3/16 to ½ the number of all the heat exchange tubes 9, are present in a range (with respect to the left-right direction) over which the baffle 39 extends, the diverging flows of refrigerant into all the heat exchange tubes 9 of the third tube group 11C, which constitutes the third path 31, can be made uniform effectively.

Second Embodiment

Figure 5:
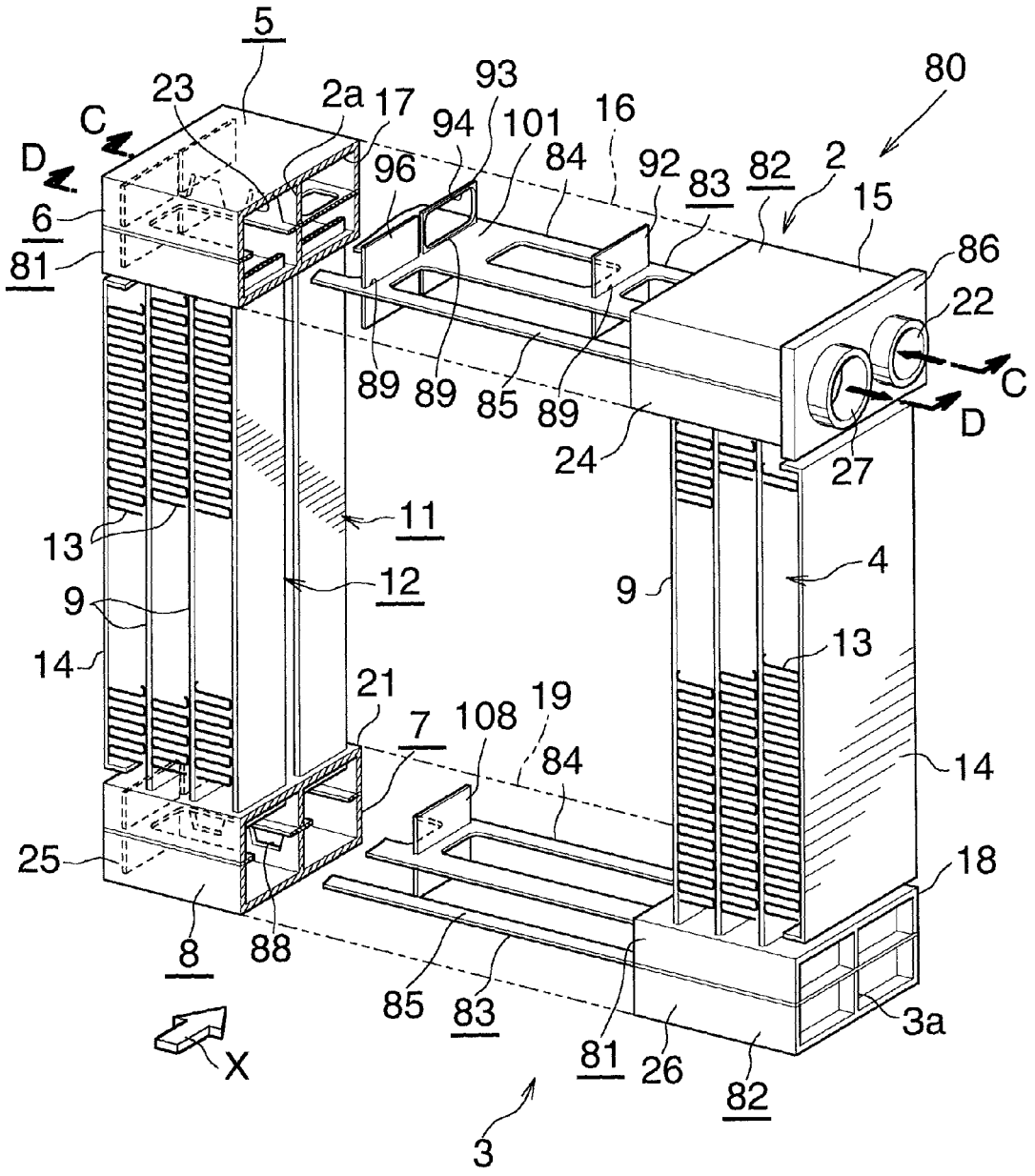
FIG. 5 is a partially cut-away perspective view showing the overall structure of an evaporator according to a second embodiment of the present invention.
Figure 6:
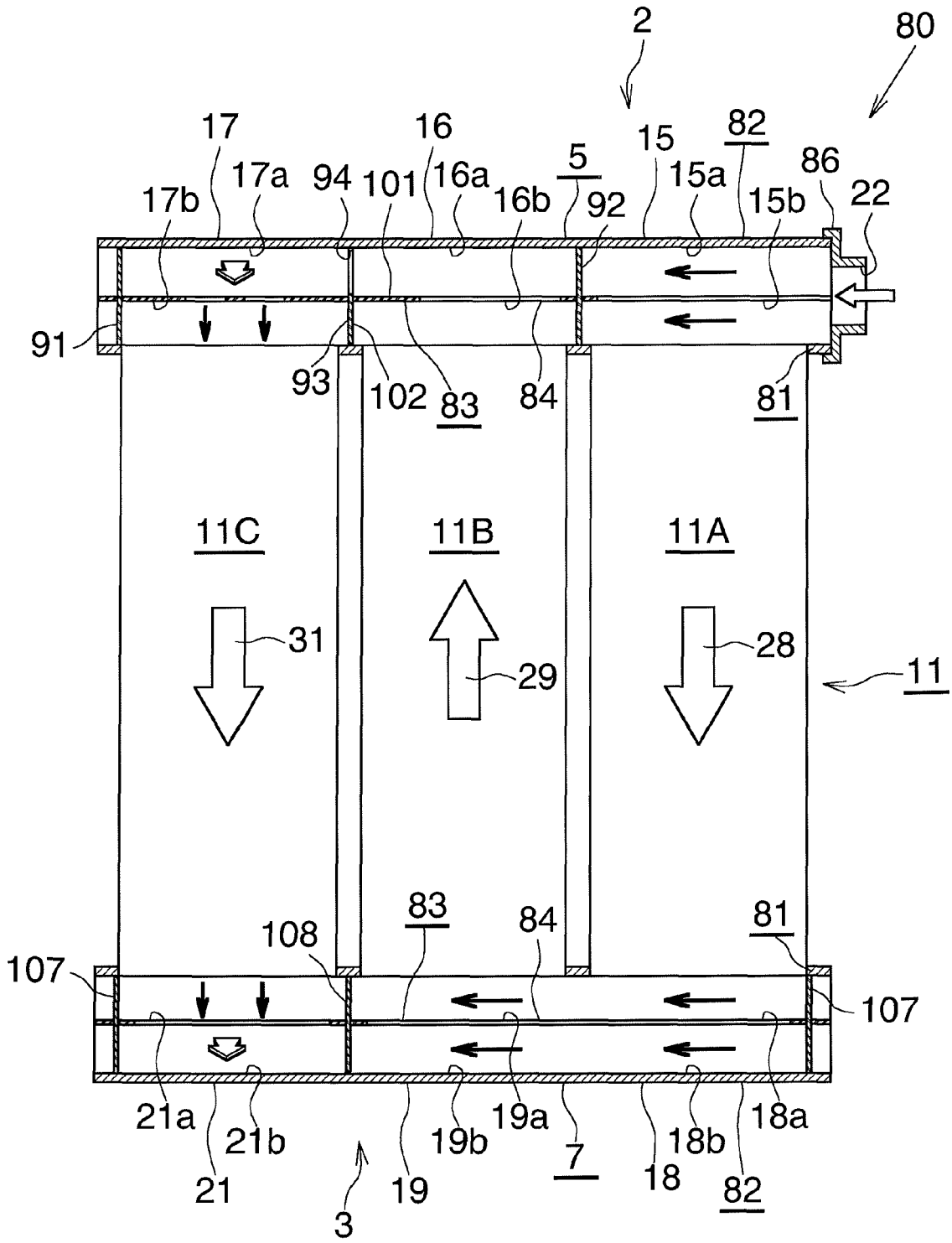
FIG. 6 is a sectional view taken along line C-C of FIG. 5 and schematically showing the structure of the evaporator of FIG. 5.
Figure 7:
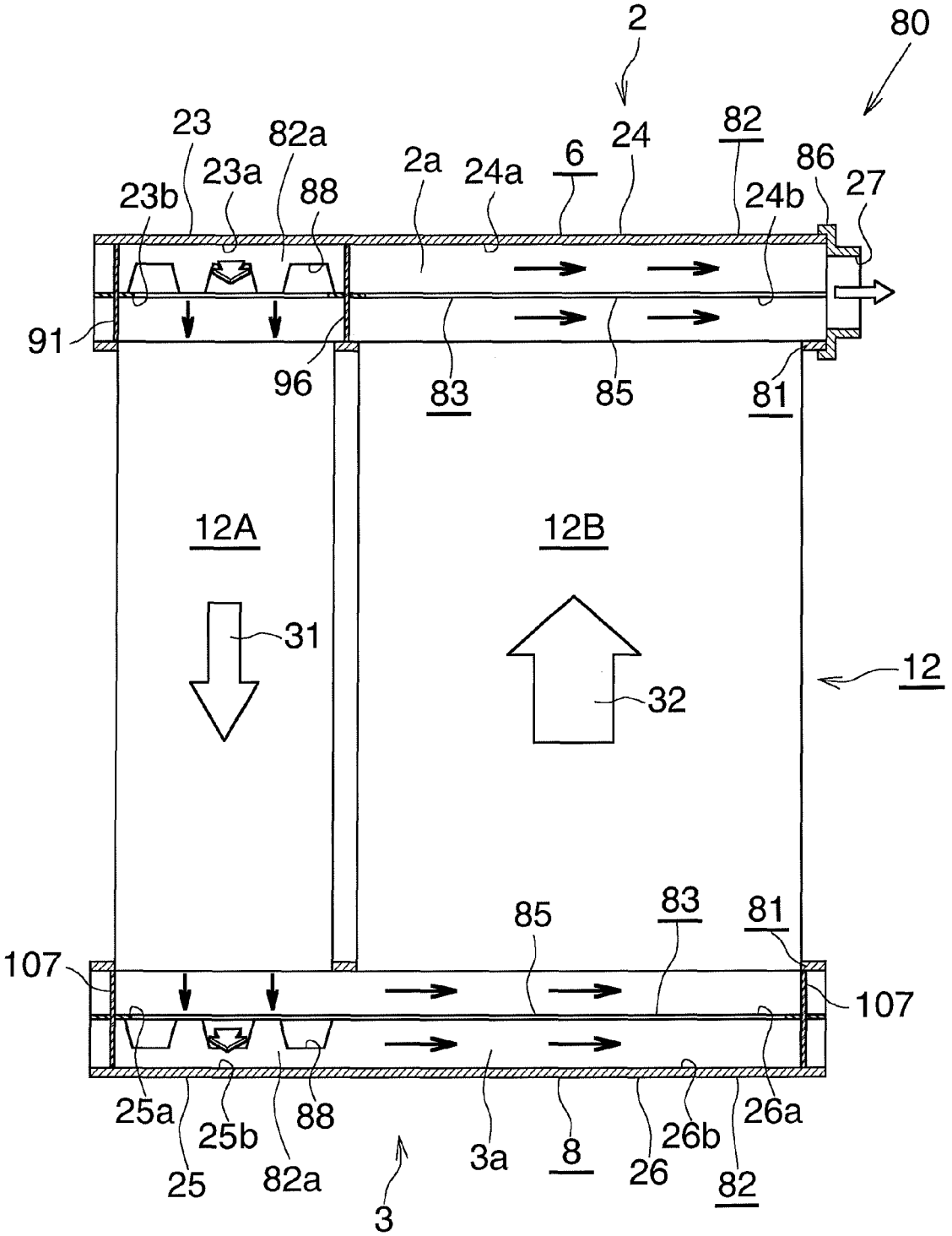
FIG. 7 is a sectional view taken along line D-D of FIG. 5 and schematically showing the structure of the evaporator of FIG. 5.
Figure 8:
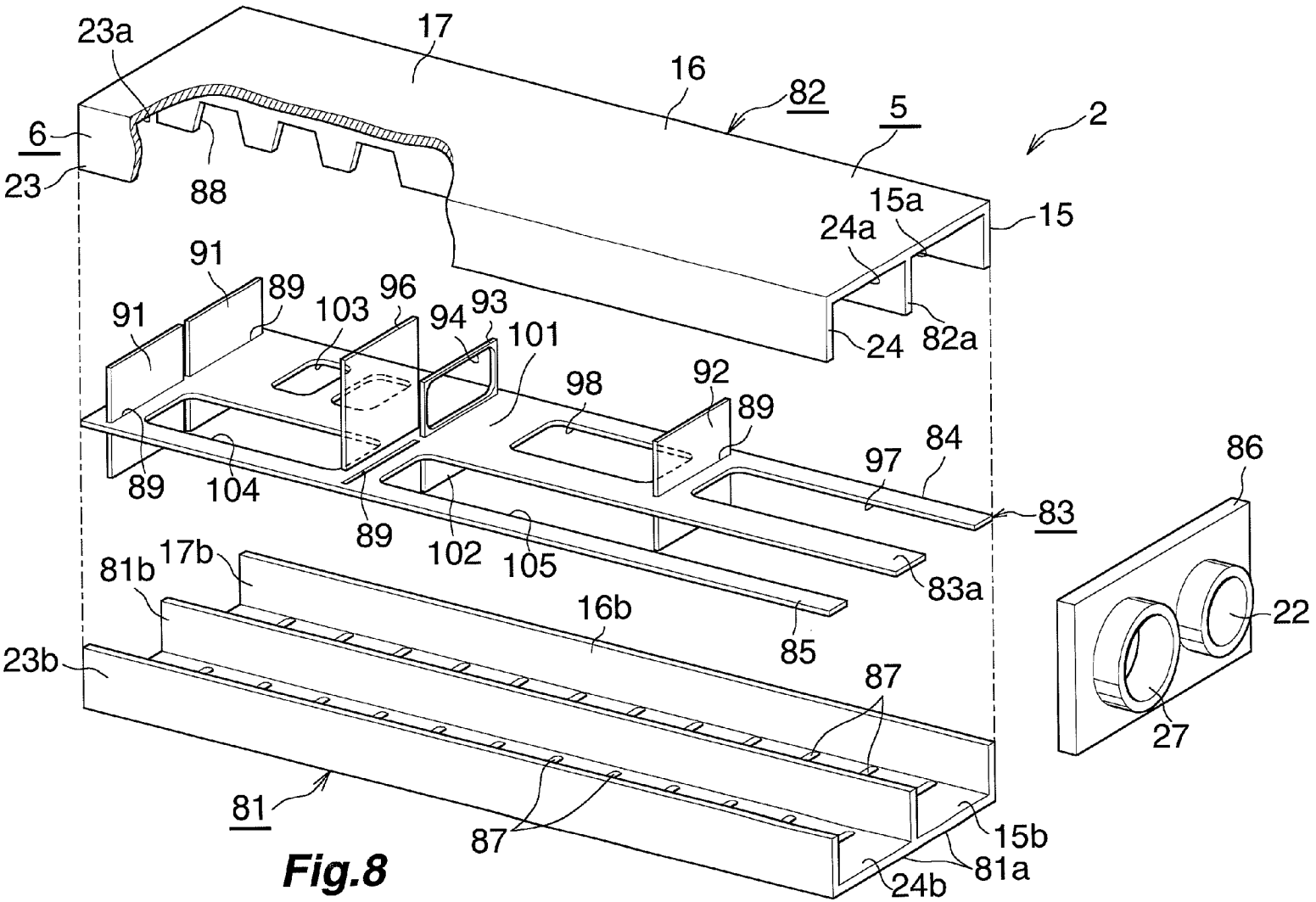
FIG. 8 is an exploded perspective view showing the upper header tank of the evaporator of FIG. 5.
Figure 9:
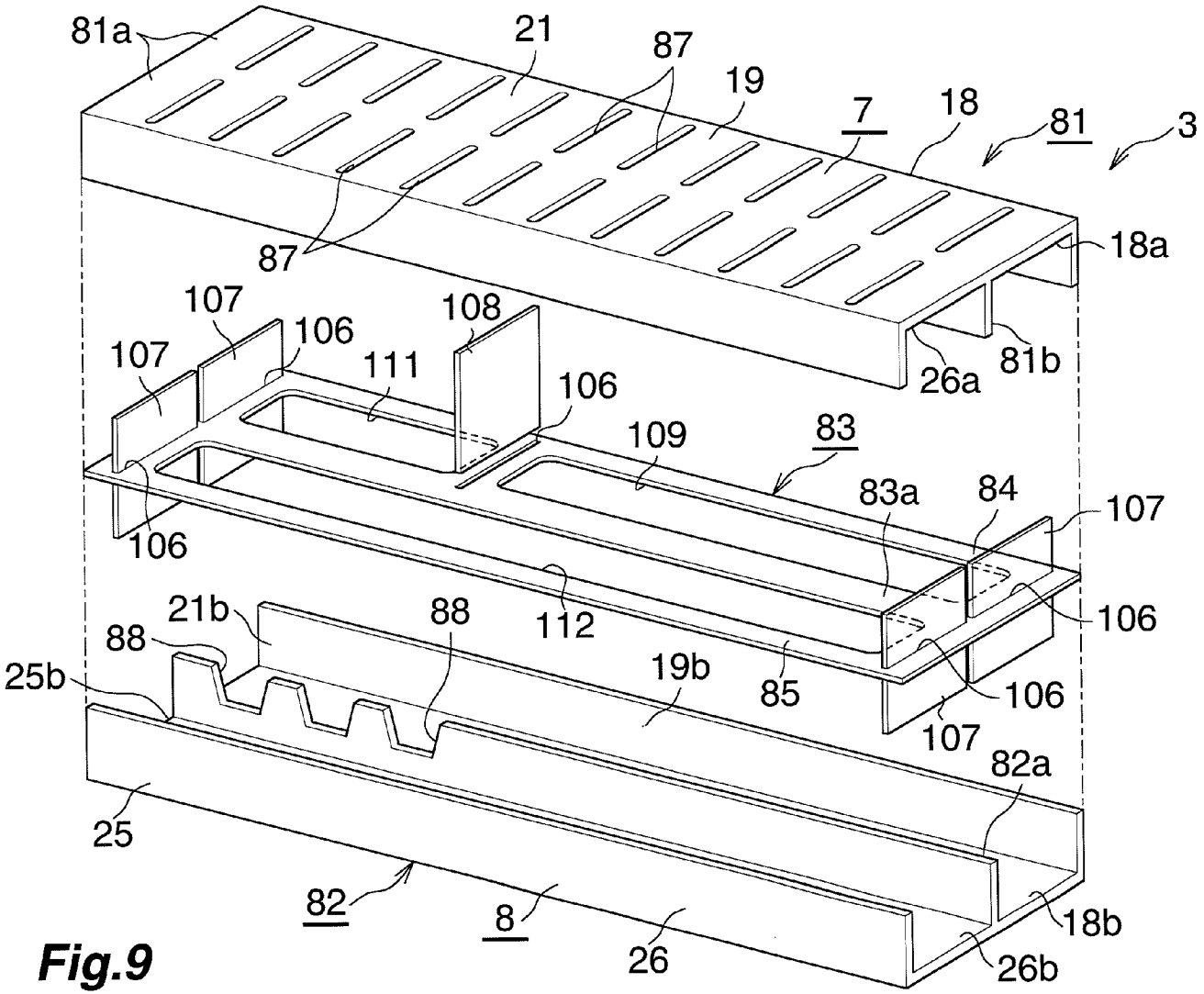
FIG. 9 is an exploded perspective view showing the lower header tank of the evaporator of FIG. 5.

FIGS. 5 to 9 show this embodiment. FIGS. 5 to 7 schematically show the overall structure of an evaporator, and FIGS. 8 and 9 are the structure of a main portion, of the evaporator. Notably, in FIGS. 6 and 7, heat exchange tubes and fins are not illustrated.

As shown in FIGS. 5 to 9, the upper header tank 2 of an evaporator 80 includes a first member 81 formed of aluminum, a second member 82 formed of aluminum, a third member 83 formed of aluminum, and an end member 86. The first member 81 forms respective lower portions of the leeward upper header portion 5 and the windward upper header portion 6, and the heat exchange tubes 9 of the two tube rows 11, 12 are connected to the first member 81. The second member 82 is brazed to the first member 81, covers the side (upper side) of the first member 81 opposite the heat exchange tubes 9, and forms respective upper portions of the leeward upper header portion 5 and the windward upper header portion 6. The third member 83 is disposed between the first member 81 and the second member 82, and has front and rear partition portions 84, 85 for partitioning the interiors of the first to third sections 15, 16, 17 of the leeward upper header portion 5 and the interiors of the fourth and fifth sections 23, 24 of the windward upper header portion 6 into respective upper and lower spaces 15*a*, 15*b*, 16*a*, 16*b*, 17*a*, 17*b*, 23*a*, 23*b*, 24*a*, 24*b*. The end member 86 has the refrigerant inlet 22 and the refrigerant outlet 27, and is brazed to the right ends of the first through third members 81, 82, 83. Each of the first through third members 81, 82, 83 and the end member 86 is formed from, for example, aluminum brazing sheet having a brazing material layer on each of opposite surfaces thereof. Notably, the third member 83 may be formed from aluminum bare material.

The first member 81 constitutes a lower portion of the front wall of the leeward upper header portion 5 and the bottom wall thereof, constitutes a lower portion of the rear wall of the windward upper header portion 6 and the bottom wall thereof, and constitutes a lower portion of the partition portion 2*a*. Tube insertion holes 87 elongated in the front-rear direction are formed, at predetermined intervals in the left-right direction, in portions 81*a* of the first member 81, which portions constitute the bottom walls of the leeward and windward upper header portions 5, 6. Upper end portions of the heat exchange tubes 9 are inserted into the tube insertion holes 87, and the heat exchange tubes 9 are brazed to the first member 81.

The second member 82 constitutes an upper portion of the front wall of the leeward upper header portion 5 and the top wall thereof, constitutes an upper portion of the rear wall of the windward upper header portion 6 and the top wall thereof, and constitutes an upper portion of the partition portion 2*a*. A portion 82*a* of the second member 82 constituting the upper portion of the partition portion 2*a* has a plurality of cutouts 88 formed in a region corresponding to the third tube group 11C, such that the cutouts 88 are provided at predetermined intervals in the left-right direction, and extend from the lower end of that portion.

The front partition portion 84 of the third member 83—which divides the interiors of the first through third sections 15, 16, 17 of the leeward upper header portion 5 into the respective upper and lower spaces 15*a*, 15*b*, 16*a*, 16*b*, 17*a*, 17*b*—and the rear partition portion 85 of the third member 83—which divides the interiors of the fourth and fifth sections 23, 24 of the windward upper header portion 6 into the respective upper and lower spaces 23*a*, 23*b*, 24*a*, 24*b*—are connected together by a connection portion 83*a*, which is interposed between a portion 81*b* of the first member 81 constituting the lower portion of the partition portion 2*a* and a portion 82*a* of the second member 82 constituting the upper portion of the partition portion 2*a*, and is brazed to the two portions 81*b*, 82*a*. The lower ends of the cutouts 88 of the second member 82 are closed by the connection portion 83*a*. Notably, a front edge portion of the front partition portion 84 is interposed between a portion of the first, member 81 constituting the lower portion of the front wall of the leeward upper header portion 5 and a portion of the second member 82 constituting the upper portion of the front wall of the leeward upper header portion 5, and is brazed to the two portions. Similarly, a rear edge portion of the rear partition portion 85 is interposed between a portion of the first member 81 constituting the lower portion of the rear wall of the windward upper header portion 6 and a portion of the second member 82 constituting the upper portion of the rear wall of the windward upper header portion 6, and is brazed to the two portions.

Slits 89 elongated in the front-rear direction are formed in the third member 83 at the left end of the front partition portion 84, at a position between the first section 15 and the second section 16, at a position between the second section 16 and the third section 17, at the left end of the rear partition portion 85, and at a position between the fourth section 23 and the fifth section 24.

A closing plate 91 formed of aluminum and adapted to close the left ends of the upper and lower spaces 17*a*, 17*b* of the third section 17 is inserted into the slit 89 at the left end of the front partition portion 84 of the third member 83, and is brazed to the three members 81, 82, 83. A partition plate 92 formed of aluminum is inserted into the slit 89 of the front partition portion 84 between the first section 15 and the second section 16 so as to separate the two sections 15, 16 from each other, and is brazed to the three members 81, 82, 83. The partition plate 92 prohibits communications between the upper and lower spaces 15*a*, 15*b* of the first section 15 and the upper and lower spaces 16*a*, 16*b* of the second section 16. A partition plate 93 formed of aluminum is inserted into the slit 89 of the front partition portion 84 between the second section 16 and the third section 17 so as to separate the two sections 16, 17 from each other, and is brazed to the three members 81, 82, 83. The partition plate 93 has a through hole 94 formed at a position above the front partition portion 84, whereby communication is established between the upper space 16*a* of the second section 16 and the upper space 17*a* of the third section 17. Also, a portion of the partition plate 93 located below the front partition portion 84 prohibits communication between the lower space 16*b* of the second section 16 and the lower space 17*b* of the third section 17.

A closing plate 91 formed of aluminum and adapted to close the left ends of the upper and lower spaces 23*a*, 23*b* of the fourth section 23 is inserted into the slit 89 at the left end of the rear partition portion 85 of the third member 83, and is brazed to the three members 81, 82, 83. A partition plate 96 formed of aluminum is inserted into the slit 89 of the rear partition portion 85 between the fourth section 23 and the fifth section 24 so as to separate the two sections 23, 24 from each other, and is brazed to the three members 81, 82, 83. The partition plate 96 prohibits communications between the upper and lower spaces 23*a*, 23*b* of the fourth section 23 and the upper and lower spaces 24*a*, 24*b* of the fifth section 24.

A cutout 97 elongated in the left-right direction is formed in a portion of the front partition portion 84 of the third member 83 located within the first section 15 such that the cutout 97 extends from the right end of the first section 15 to the vicinity of the partition plate 92. The cutout 97 establishes communication between the upper and lower spaces 15*a*, 15*b* of the first section 15, and establishes communication between the refrigerant inlet 22 and the upper and lower spaces 15*a*, 15*b*. A through hole 98 is formed in a portion of the front partition portion 84 located within the second section 16, excluding a region which is located on the side toward the left end of the second section 16 and having a predetermined length. The through hole 98 establishes communication between the upper and lower spaces 16*a*, 16*b* of the second section 16. A part of a portion of the front partition portion 84 located within the second section 16, the part being located on the left side of the through hole 98 forms a platelike baffle 101, which divides a portion of the interior of the second section 16 into upper and lower spaces and prevents flow of refrigerant toward the upper space. Also, a portion of the partition plate 93 located below the front partition portion 84 forms a flow prevention portion 102, which prevents flow of refrigerant from the second section 16 to the third section 17. Furthermore, the through hole 94 of the partition plate 93 establishes communication between the second section 16 and the third section 17 in a region or space above the baffle 101. Moreover, a plurality of through holes 103 are formed, at predetermined intervals in the left-right direction, in a portion of the front partition portion 84 located within the third section 17. The through holes 103 establishes communication between the upper and lower spaces 17*a*, 17*b* of the third section 17.

A through hole 104 is formed in a portion of the rear partition portion 85 of the third member 83 located within the fourth section 23, and the through hole 104 establishes communication between the upper and lower spaces 23*a*, 23*b* of the fourth section 23. A cutout 105 elongated in the left-right direction is formed in a portion of the rear partition portion 85 of the third member 83 located within the fifth section 24 such that the cutout 105 extends from the right end of the fifth section 24 to the vicinity of the partition plate 96. The cutout 105 establishes communication between the upper and lower spaces 24*a*, 24*b* of the fifth section 24, and establishes communication between the refrigerant outlet 27 and the upper and lower spaces 24*a*, 24*b*.

As specifically shown in FIG. 9, the lower header tank 3 has a structure substantially the same as that of the upper header tank 2, and is disposed upside down in relation to the upper header tank 2. The first member 81 forms upper portions of the leeward lower header portion 7 and the windward lower header portion 8; and the second member 82 covers the lower side of the first member 81 and forms lower portions of the leeward lower header portion 7 and the windward lower header portion 8. The front and rear partition portions 84, 85 of the third member 83 divide the interiors of the first through third sections 18, 19, 21 of the leeward lower header portion 7 and the interiors of the fourth and fifth sections 25, 26 of the windward lower header portion 8 into respective upper and lower spaces 18*a*, 18*b*, 19*a*, 19*b*, 21*a*, 21*b*, 25*a*, 25*b*, 26*a*, 26*b*. The structures of the first member 81 and the second member 82 of the lower header tank 3 are the same as those of the first member 81 and the second member 82 of the upper header tank 2. Notably, since the refrigerant inlet 22 and the refrigerant outlet 27 are not provided on the lower header tank 3, the lower header tank 3 does not include the end member.

Slits 106 elongated in the front-rear direction are formed in the third member 83 at the left and right ends of the front partition portion 84, at a position between the second section 19 and the third section 21, and at the left and right ends of the rear partition portion 85.

A closing plate 107 formed of aluminum and adapted to close the right ends of the upper and lower spaces 18*a*, 18*b* of the first section 18 is inserted into the slit 106 at the right end of the front partition portion 84 of the third member 83, and is brazed to the three members 81, 82, 83. Similarly, a closing plate 107 formed of aluminum and adapted to close the right ends of the upper and lower spaces 21*a*, 21*b* of the third section 21 is inserted into the slit 106 at the left end of the front partition portion 84 of the third member 83, and is brazed to the three members 81, 82, 83. A partition plate 108 formed of aluminum is inserted into the slit 106 of the front partition portion 84 between the second section 19 and the third section 21 so as to separate the two sections 19, 21 from each other, and is brazed to the three members 81, 82, 83. The partition plate 108 prohibits communications between the upper and lower spaces 19*a*, 19*b* of the second section 19 and the upper and lower spaces 21*a*, 21*b* of the third section 21. Notably, the upper and lower spaces 18*a*, 18*b* of the first section 18 communicate with the upper and lower spaces 19*a*, 19*b* of the second section 19, respectively.

A closing plate 107 formed of aluminum and adapted to close the left ends of the upper and lower spaces 25*a*, 25*b* of the fourth section 25 is inserted into the slit 106 at the left end of the rear partition portion 85 of the third member 83, and is brazed to the three members 81, 82, 83. Similarly, a closing plate 107 formed of aluminum and adapted to close the right ends of the upper and lower spaces 26*a*, 26*b* of the fifth section 26 is inserted into the slit 106 at the right end of the rear partition portion 85 of the third member 83, and is brazed to the three members 81, 82, 83. Notably, the upper and lower spaces 25*a*, 25*b* of the fourth section 25 communicate with the upper and lower spaces 26*a*, 26*b* of the fifth section 26, respectively.

A through hole 109 is formed in a part of the front partition portion 84 of the third member 83, the part extending across the first section 18 and the second section 19. The through hole 109 establishes communications between the upper and lower spaces 18*a*, 18*b* of the first section 18 and between the upper and lower spaces 19*a*, 19*b* of the second section 19. A through hole 111 is formed in a portion of the front partition portion 84 located in the third section 21. The through hole 111 establishes communication between the upper and lower spaces 21*a*, 21*b* of the third section 21.

A through hole 112 is formed in a part of the rear partition portion 85 of the third member 83, the part extending across the fourth section 25 and the fifth section 26. The through hole 112 establishes communications between the upper and lower spaces 25*a*, 25*b* of the fourth section 25 and between the upper and lower spaces 26*a*, 26*b* of the fifth section 26.

The upper space 21*a* of the third section 21 of the lower space 7*a* of the leeward lower header portion 7 and the upper space 25*a* of the fourth section 25 of the windward lower header portion 8 communicate with each other via the cutouts 88 which are formed on the portion 82*a* of the second member 82 constituting the upper portion of the partition portion 3*a*, and are closed by the connection portion 83*a* of the third member 83.

The flow of refrigerant in the above-described evaporator 80 is the same as that in the evaporator 1 of the first embodiment. However, refrigerant flows from the third section 17 of the leeward upper header portion 5 into the upper space 23*a* of the fourth section 23 of the windward lower header portion 6 via the cutouts 88. Similarly, refrigerant flows from the lower space 21*b* of the third section 21 of the leeward lower header portion 7 into the lower space 25*b* of the fourth section 25 of the windward lower header portion 8 via the cutouts 88

Third Embodiment

Figure 10:
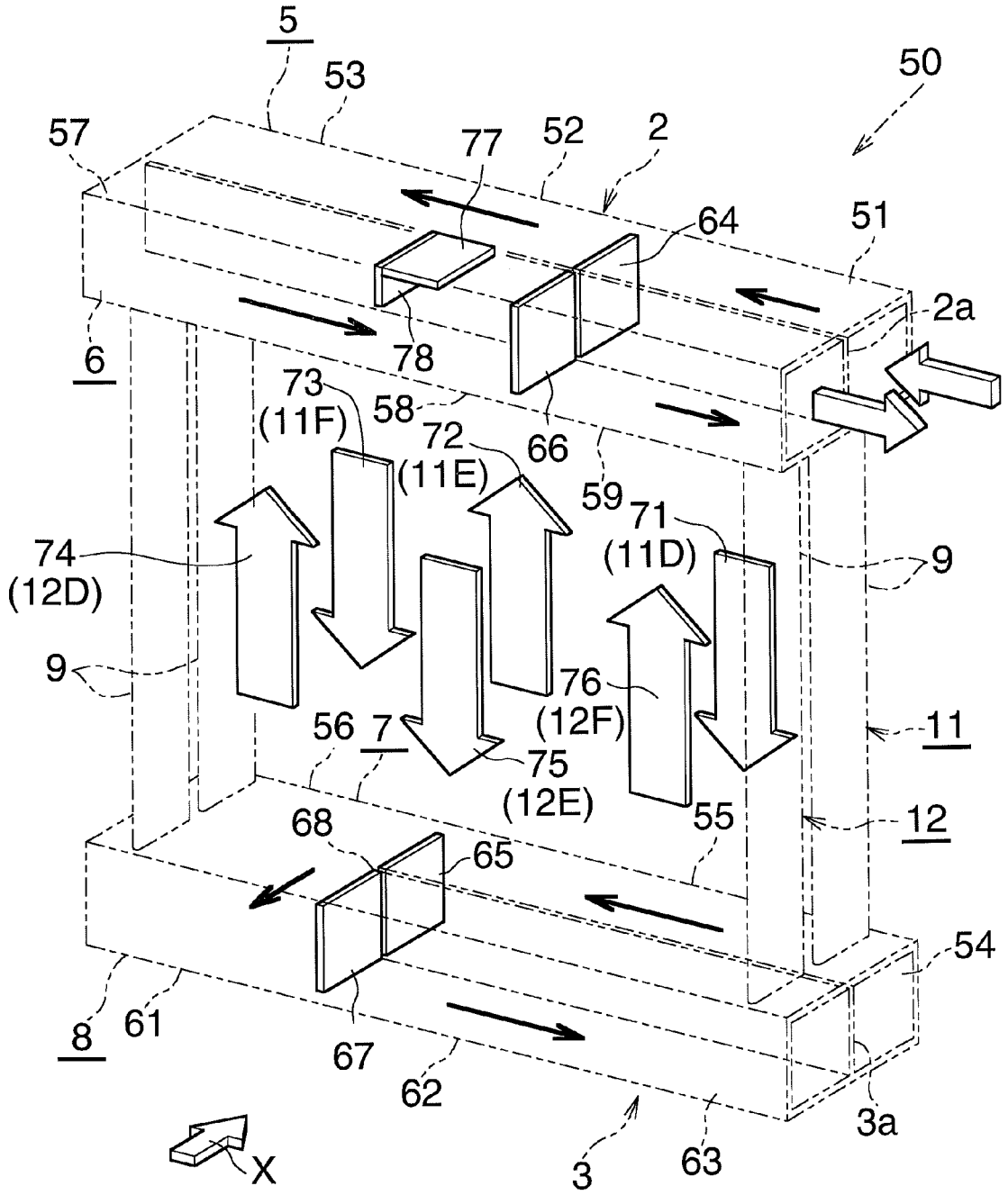
FIG. 10 is a perspective view schematically showing the structure of an evaporator according to a third embodiment of the present invention and the flow of refrigerant within the evaporator.
Figure 12:
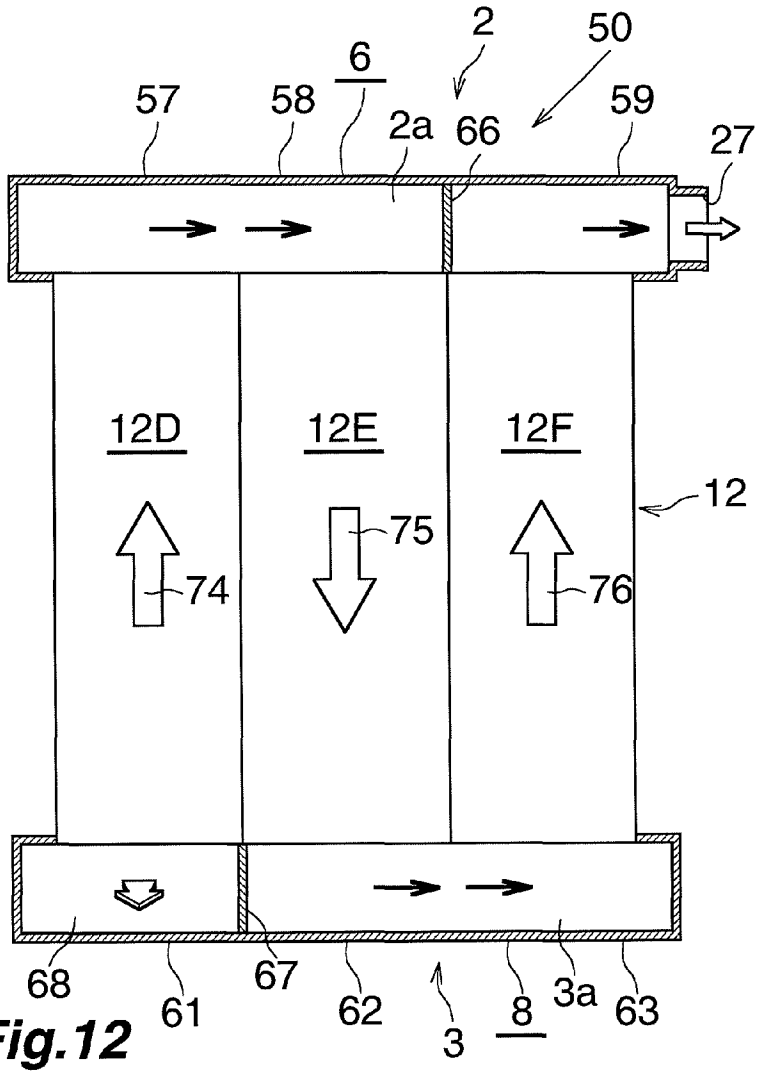
FIG. 12 is a partially omitted vertical cross section of windward upper and lower header portions as viewed frontward from the rear side in order to schematically show the structure of the evaporator of FIG. 10.
Figure 11:
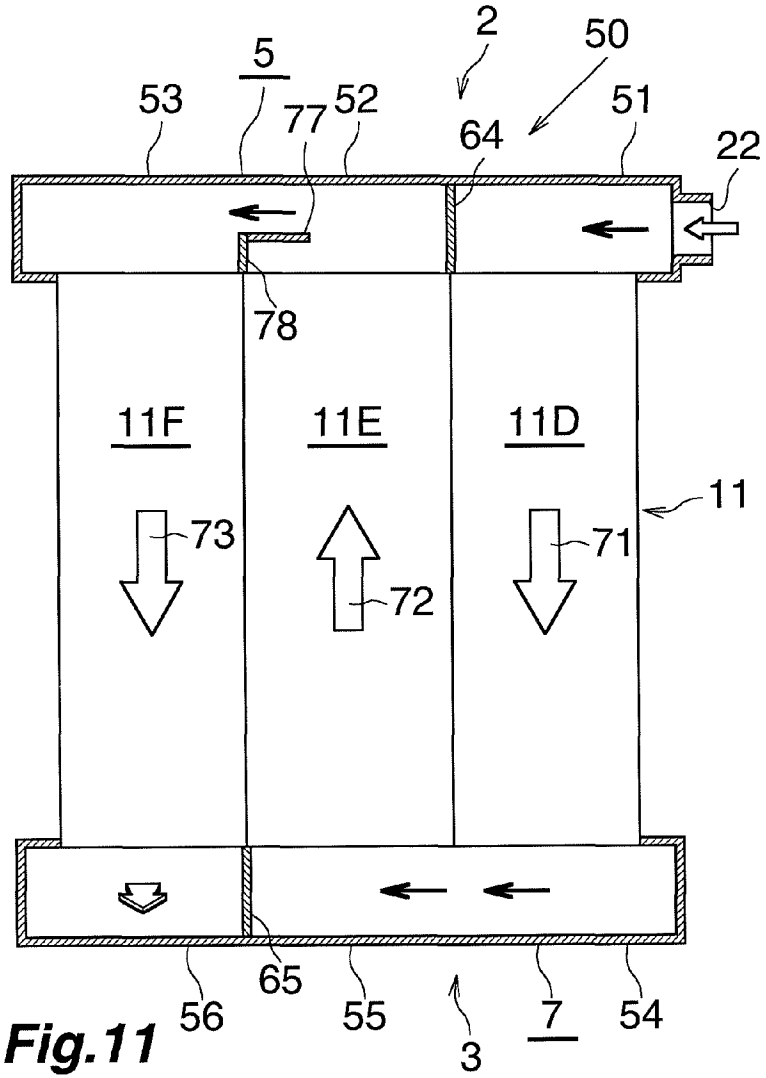
FIG. 11 is a partially omitted vertical cross section of leeward upper and lower header portions as viewed frontward from the rear side in order to schematically show the structure of the evaporator of FIG. 10.

FIGS. 10 to 12 show this embodiment. FIGS. 10 to 12 schematically show the overall structure of an evaporator. In FIGS. 10 and 12, heat exchange tubes and fins are not illustrated.

As shown in FIGS. 10 to 12, the leeward tube row 11 of an evaporator 50 includes three tube groups 11D, 11E, 11F, each of which is composed of a plurality of heat exchange tubes 9 and which are arranged, in a juxtaposed condition, from the right end toward the left end. The windward tube row 12 of the evaporator 50 includes three (the same number as the number of the tube groups of the leeward tube row 11) tube groups 12D, 12E, 12F, each of which is composed of a plurality of heat exchange tubes 9 and which are arranged, in a juxtaposed condition, from the left end toward right end.

The leeward upper header portion 5 includes sections 51, 52, 53, the number of which is equal to the number of the tube groups 11D, 11E, 11F of the leeward tube row 11 and which communicate with the heat exchange tubes 9 of the tube groups 11D, 11E, 11F. Similarly, the leeward lower header portion 7 includes sections 54, 55, 56, the number of which is equal to the number of the tube groups 11D, 11E, 11F of the leeward tube row 11 and which communicate with the heat exchange tubes 9 of the tube groups 11D, 11E, 11F. The refrigerant inlet 22 is provided at the right end of the right end section 51 of the leeward upper header portion 5. The three tube groups 11D, 11E, 11F of the leeward tube row 11 will be referred to as the first through third tube groups, from the end where the refrigerant inlet 22 is provided toward the opposite end. The sections 51, 52, 53 and the sections 54, 55, 56 which communicate with the heat exchange tubes 9 of the first through third tube groups 11D, 11E, 11F will be referred to as the first through third sections, from the end where the refrigerant inlet 22 is provided toward the opposite end.

The windward upper header portion 6 includes sections 57, 58, 59, the number of which is equal to the number of the tube groups 12D, 12E, 12F of the windward tube row 12 and which communicate with the heat exchange tubes 9 of the tube groups 12D, 12E, 12F. Similarly, the windward lower header portion 8 includes sections 61, 62, 63, the number of which is equal to the number of the tube groups 12D, 12E, 12F of the windward tube row 12 and which communicate with the heat exchange tubes 9 of the tube groups 12D, 12E, 12F. The refrigerant outlet 27 is provided at the right end (the same end where the refrigerant inlet 22 is provided) of the right end section 59 of the windward upper header portion 6. The three tube groups 12D, 12E, 12F of the windward tube row 12 will be referred to as the fourth through sixth tube groups, from the end opposite the refrigerant outlet 27 toward the end where the refrigerant outlet 27 is provided. The sections 57, 58, 59 and the sections 61, 62, 63 which communicate with the heat exchange tubes 9 of the fourth through sixth tube groups 12D, 12E, 12F will be referred to as the fourth through sixth sections, from the end opposite the refrigerant outlet 27 toward the end where the refrigerant outlet 27 is provided.

A partition wall 64 is provided between the first section 51 and the second section 52 of the leeward upper header portion 5, whereby communication between the two sections 51, 52 is prohibited. The second section 52 and the third section 53 of the leeward upper header portion 5 communicate with each other.

The first section 54 of the leeward lower header portion 7 is fully opened at its left end, and the second section 55 thereof is fully opened at its right end, whereby the two sections 54, 55 communicate with each other. Thus, refrigerant flows straight and leftward from the first section 54 into the second section 55. A partition wall 65 is provided between the second section 55 and the third section 56 of the leeward lower header portion 7, whereby communication between the two sections 55, 56 is prohibited.

The fourth section 57 of the windward upper header portion 6 is fully opened at its right end, and the fifth section 58 thereof is fully opened at its left end, whereby the two sections 57, 58 communicate with each other. Thus, refrigerant flows straight and rightward from the fourth section 57 into the fifth section 58. A partition wall 66 is provided between the fifth section 58 and the sixth section 59 of the windward upper header portion 6, whereby communication between the two sections 58, 59 is prohibited.

A partition wall 67 is provided between the fourth section 61 and the fifth section 62 of the windward lower header portion 8, whereby communication between the two sections 61, 62 is prohibited. The fifth section 62 of the windward lower header portion 8 is fully opened at its right end, and the sixth section 63 thereof is fully opened at its left end, whereby the two sections 62, 63 communicate with each other. Thus, refrigerant flows straight and rightward from the fifth section 62 into the sixth section 63.

The third section 56 of the leeward lower header portion 7 and the fourth section 61 of the windward lower header portion 8 communicate with each other via the communication opening 68 provided in the partition portion 3*a* of the second header tank 3.

As a result of provision of the sections 51 to 59 and 61 to 63, the refrigerant inlet 22, the refrigerant outlet 27, and the communication opening 68 as described above, refrigerant flows, from the upper side toward the lower side, through the heat exchange tubes 9 of the first tube group 11D, the third tube group 11F, and the fifth tube group 12E, and flows, from the lower side toward the lower side, through the heat exchange tubes 9 of the second tube group 11E, the fourth tube group 12D, and the sixth tube group 12F. That is, the second tube group 11E, the fourth tube group 12D, and the sixth tube group 12F are upward flow tube groups each of which is formed by arranging a plurality of heat exchange tubes 9 at predetermined intervals in the left-right direction and in which refrigerant flows through the heat exchange tubes 9 from the lower side toward the upper side; and the first tube group 11D, the third tube group 11F, and the fifth tube group 12E are downward flow tube groups each of which is formed by arranging a plurality of heat exchange tubes 9 at predetermined intervals in the left-right direction and in which refrigerant flows through the heat exchange tubes 9 from the upper side toward the lower side. Thus, the first tube group 11D forms a first path 71 which is a downflow path in which refrigerant flows from the upper side toward the lower side; the second tube group 11E forms a second path 72 which is an upflow path in which refrigerant flows from the lower side toward the upper side; the third tube group 11F forms a third path 73 which is a downflow path in which refrigerant flows from the upper side toward the lower side; the fourth tube group 12D forms a fourth path 74 which is an upflow path in which refrigerant flows from the lower side toward the upper side; the fifth tube group 12E forms a fifth path 75 which is a downflow path in which refrigerant flows from the upper side toward the lower side; and the sixth tube group 12F forms a sixth path 76 (the final path) which is an upflow path in which refrigerant flows from the lower side toward the upper side. Thus, in the evaporator 50, upflow paths each of which is formed by a plurality of heat exchange tubes 9 and in which refrigerant flows through the heat exchange tubes 9 from the lower side toward the upper side and downflow paths each of which is formed by a plurality of heat exchange tubes 9 and in which refrigerant flows through the heat exchange tubes 9 from the upper side toward the lower side are alternately arranged such that the sixth path (the final path) 76 serves as an upflow path.

The leeward tube row 11 of the evaporator 50 includes a first tube group set composed of the second tube group 11E, which is an upward flow tube group, and the third tube group 11F, which is a downward flow tube group located adjacent to and leftward of the second tube group 11E (on the downstream side of the second tube group 11E with respect to the refrigerant flow direction). The windward tube row 12 of the evaporator 50 includes a second tube group set composed of the fourth tube group 12D, which is an upward flow tube group and the fifth tube group 12E, which is a downward flow tube group located adjacent to and rightward of the fourth tube group 12D (on the downstream side of the fourth tube group 12D with respect to the refrigerant flow direction). The second section 52 of the leeward upper header portion 5 serves as a refrigerant inflow section which communicates with upper end portions of the heat exchange tubes 9 of the second tube group 11E (the upward flow tube group of the first tube group set) and into which refrigerant flows from the heat exchange tubes 9. The third section 53 serves as a refrigerant outflow section which communicates with upper end portions of the heat exchange tubes 9 of the third tube group 11F (a downward flow tube group which constitutes, together with the second tube group 11E, the first tube group set) and from which refrigerant flows into the heat exchange tubes 9. Similarly, the fourth section 57 of the windward upper header portion 6 serves as a refrigerant inflow section which communicates with upper end portions of the heat exchange tubes 9 of the fourth tube group 12D (the upward flow tube group of the second tube group set) and into which refrigerant flows from the heat exchange tubes 9. The fifth section 58 serves as a refrigerant outflow section which communicates with upper end portions of the heat exchange tubes 9 of the fifth tube group 12E (a downward flow tube group which constitutes, together with the fourth tube group 12D, the second tube group set) and from which refrigerant flows into the heat exchange tubes 9.

A horizontal, platelike baffle 77 and a flow prevent portion 78 are provided for at least one tube group set (in the present embodiment, the tube group set composed of the second tube group 11E and the third tube group 11F). The baffle 77 is provided in the second section 52 (the refrigerant inflow section), which communicates with the upper end portions of the heat exchange tubes 9 of the second tube group 11E (the upward flow tube group), such that the baffle 77 is located at the center in the vertical direction and is located on the left side; i.e., the side toward the third section 53 (the refrigerant outflow section), which communicates with the upper end portions of the heat exchange tubes 9 of the third tube group 11F (the downward flow tube group). The baffle 77 divides a portion of the interior of the second section 52 into upper and lower spaces, and prevents flow of refrigerant toward the upper space. Under the baffle 77, a flow prevention portion 78 is provided between the second section 52 and the third section 53 in order to prevent flow of refrigerant from the second section 52 to the third section 53. Also, the second section 52 is opened at its left end in a region above the baffle 77, and the third section 53 is opened at its right end in the region above the baffle 77, whereby the two sections 52, 53 communicate with each other in the region above the baffle 77.

Preferably, of all the heat exchange tubes 9 of the second tube group 11E communicating with the second section 52 in which the baffle 77 is provided, heat exchange tubes 9, the number of which is 3/16 to ½ the number of all the heat exchange tubes 9, are present in a range (with respect to the left-right direction) over which the baffle 77 extends.

The above-described evaporator 50, together with a compressor, a condenser serving as a refrigerant cooler, and an expansion valve serving as a pressure reducer, constitutes a refrigeration cycle which is installed in a vehicle, such as an automobile, as a car air conditioner. When the car air conditioner is operated, the refrigerant having passed through the compressor, the condenser, and the expansion valve enters the first section 51 of the leeward upper header portion 5 through the refrigerant inlet 22. The refrigerant having entered the first section 51 flows into the heat exchange tubes 9 of the second tube group 11E, which constitutes the second path 72, via the first tube group 11D, which constitutes the first path 71, and the first and second sections 54, 55 of the leeward lower header portion 7.

The refrigerant having flowed into the heat exchange tubes 9 of the second tube group 11E flows upward through the heat exchange tubes 9, and enters the second section 52 of the leeward upper header portion 5. The refrigerant having flowed into a region within the second section 52 where the baffle 77 is provided (having flowed in a region located leftward of the right end of the baffle 77) first flows rightward along the baffle 77, flows upward beyond the baffle 77, flows leftward in a region within the second section 52 above the baffle 77, and then flows into the third section 53. Meanwhile, refrigerant having flowed into a region within the second section 52 where the baffle 77 is not provided (having flowed in a region located rightward of the right end of the baffle 77) flows upward beyond the baffle 77, flows leftward in a region within the second section 52 above the baffle 77, and then enters the third section 53.

The refrigerant having flowed into the third section 53 flows into the heat exchange tubes 9 of the third tube group 11F, which constitutes the third path 73. The refrigerant having flowed into the heat exchange tubes 9 of the third tube group 11F flows downward through the heat exchange tubes 9, and enters the fourth section 56 of the leeward lower header portion 7. The refrigerant then passes through the communication opening 68, and enters the fourth section 61 of the windward lower header portion 8. The refrigerant having entered the fourth section 61 enters the sixth section 59 of the windward upper header portion 6 via the fourth tube group 12D, which constitutes the fourth path 74, the fourth and fifth sections 57, 58 of the windward upper header portion 6, the fifth tube group 12E, which constitutes the fifth path 75, the fifth and sixth sections 62, 63 of the windward lower header portion 8, and the sixth tube group 12F, which constitutes the sixth path 76. The refrigerant then flows out trough the refrigerant outlet 27.

While refrigerant flows through the heat exchange tubes 9 of the leeward tube row 11 and the heat exchange tubes 9 of the windward tube row 12, heat exchange is performed between the refrigerant and air passing through the air-passing clearances of the heat exchange core portion 4 (see the arrow X of FIG. 5), whereby the air is cooled, and the refrigerant flows out in the gas phase.

In the above-described evaporator 50, since the baffle 77 is provided within the second section 52 of the leeward upper header portion 5, a portion of refrigerant having flowed into the second section 52 after having had separated into gas and liquid as a result of partial evaporation thereof while flowing through the first tube group 11D and the second tube group 11E flows over a long distance along the baffle 77, whereby the gas phase component and the liquid phase component are mixed sufficiently. Therefore, it is possible to prevent the liquid phase component from concentratedly flowing, in a large amount, into the heat exchange tubes 9 of the third tube group 11F located on the upstream side (right side), which flows would otherwise occur due to the influence of gravity. Thus, refrigerant having gas and liquid phase components and having a constant dryness uniformly enters all the heat exchange tubes 9 of the third tube group 11F, whereby diverging flows of refrigerant into all the heat exchange tubes 9 of the third tube group 11F, which construes the third path 73, can be made uniform. In particular, in the case where, of all the heat exchange tubes 9 of the second tube group 11E communicating with the second section 52 in which the baffle 77 is provided, heat exchange tubes 9, the number of which is 3/16 to ½ the number of all the heat exchange tubes 9, are present in a range (with respect to the left-right direction) over which the baffle 77 extends, the diverging flows of refrigerant into all the heat exchange tubes 9 of the third tube group 11F, which constitutes the third path 73, can be made uniform effectively.

The evaporator of the present invention can be applied to a so-called laminated-type evaporator configured such that a plurality of flat hollow bodies each composed of a pair of dish-shaped plates which faces each other and are brazed together along the circumferential edges thereof are disposed in parallel. Each flat hollow body has two vertically extending heat exchange tubes which are juxtaposed in the air-passage direction, and header forming portions which communicate with the upper and lower ends, respectively, of the two heat exchange tubes. The flat hollow bodies are brazed together such that the upper header forming portions of all the flat hollow bodies communicate with one another and the lower header forming portions of all the flat hollow bodies communicate with one another, whereby two tube rows each including a plurality of heat exchange tubes which extend vertically and are spaced from one another in the longitudinal direction of the header portions are juxtaposed in the air-passage direction. The header forming portions of all the flat hollow bodies form the leeward upper and lower header portions and the windward upper and lower header portions which communicate with the upper and lower ends of the leeward tube row and the upper and lower ends of the windward tube row, respectively.

What is claimed is:

1. An evaporator comprising:

an upper header portion extending along a width direction of the evaporator substantially perpendicular to an air-passage direction of the evaporator, the upper header portion having a breadth in the air-passage direction, a bottom wall, and an upper wall opposite to the bottom wall in a substantially vertical direction perpendicular to the width direction and the air flow direction;

a lower header portion provided to extend along the width direction;

a plurality of heat exchange tubes each extending in the substantially vertical direction between the upper header portion and the lower header portion and each having an upper end portion and a lower end portion opposite to the upper end portion in the substantially vertical direction, said each upper end portion being connected to the upper header portion, said each lower end portion being connected to the lower header portion, the plurality of heat exchange tubes comprising:

an upward heat exchange tube group comprising upward heat exchange tubes through which refrigerant is to flow from the lower header portion toward the upper header portion; and a downward heat exchange tube group provided next to the upward heat exchange tube group and comprising downward heat exchange tubes through which the refrigerant is to flow from the upper header portion toward the lower header portion;

a flow prevention member provided in the upper header portion between the upward heat exchange tube group and the downward heat exchange tube group to extend from the bottom wall to a tip end of the flow prevention member toward the upper wall across an entirety of the breadth of the upper header portion, the refrigerant being to flow from the upward heat exchange tube group to the downward heat exchange tube group via a space which is formed between the tip end of the flow prevention member and the upper wall; and a horizontal baffle provided in the upper header portion across the entirety of the breadth of the upper header portion to extend from the tip end of the flow prevention member toward the upward heat exchange tube group above the upward heat exchange tubes in the upward heat exchange tube group, no horizontal baffle being provided to extend from the tip end of the flow prevention member toward the downward heat exchange tube group.

2. The evaporator according to claim 1, wherein the upper header portion comprises an upstream upper header portion and a downstream upper header portion provided at a downstream side in the air-passage direction with respect to the upstream upper header portion, the lower header portion comprises an upstream lower header portion and a downstream lower header portion provided at a downstream side in the air-passage direction with respect to the upstream lower header portion, the flow prevention member is provided in the downstream upper header portion across an entirety of a breadth of the downstream upper header portion;

the horizontal baffle is provided in the downstream upper header portion across the entirety of the breadth of the downstream upper header portion; and the plurality of heat exchange tubes comprise an upstream heat exchange tube row connecting the upstream upper header portion and the upstream lower header portion; and a downstream heat exchange tube row connecting the downstream upper header portion and the downstream lower header portion and provided at a downstream side in the air-passage direction with respect to the upstream heat exchange tube row.

3. The evaporator according to claim 2, wherein the evaporator has one end and another end opposite to the one end in the width direction of the evaporator, wherein a refrigerant inlet is provided in the upper header portion or the lower header portion at the one end, wherein the upstream heat exchange tube row includes a farthest upstream heat exchange tube group at the another end, wherein the downstream heat exchange tube row includes a farthest downstream heat exchange tube group at the another end, the refrigerant is to flow in the farthest upstream heat exchange tube group and the farthest downstream heat exchange tube group in a same direction.

* * * * *